US010785560B2

(12) United States Patent
Bezzola et al.

(10) Patent No.: US 10,785,560 B2
(45) Date of Patent: Sep. 22, 2020

(54) WAVEGUIDE FOR A HEIGHT CHANNEL IN A SPEAKER

(71) Applicant: Samsung Electronics Co., Ltd., Suwon-si, Gyeonggi-do (KR)

(72) Inventors: Andri Bezzola, Pasadena, CA (US); Allan Devantier, Newhall, CA (US)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 0 days.

(21) Appl. No.: 15/497,073

(22) Filed: Apr. 25, 2017

(65) Prior Publication Data

US 2017/0325019 A1 Nov. 9, 2017

Related U.S. Application Data

(60) Provisional application No. 62/333,673, filed on May 9, 2016.

(51) Int. Cl.
*H04R 1/34* (2006.01)
*H04R 1/26* (2006.01)
*H04R 1/30* (2006.01)

(52) U.S. Cl.
CPC ..... *H04R 1/345* (2013.01); *H04R 1/26* (2013.01); *H04R 1/30* (2013.01)

(58) Field of Classification Search
CPC ..... H04R 1/323; H04R 1/02; H04R 1/025; H04R 1/26; H04R 1/30; H04R 1/34; H04R 1/345; H04R 1/40; H04R 1/403
(Continued)

(56) References Cited

U.S. PATENT DOCUMENTS 4,266,092 A * 5/1981 Barker, III ..... H04R 1/345 181/144
5,398,992 A 3/1995 Daniels
(Continued)

FOREIGN PATENT DOCUMENTS

JP 2013118496 A 6/2013
WO 2013103290 A1 7/2013
(Continued)

OTHER PUBLICATIONS

Anonymous, "Creative X-FI Sonic Carriers Stole the Thunder at CES 2016 Las Vegas," Press Release, Creative Technology Ltd., Jan. 19, 2016, pp. 1-3, Singapore [downloaded from https://www.creative.com/corporate/pressroom/?id=13496&utm%20medium=web&utm_source on Jun. 28, 2016].
(Continued)

*Primary Examiner* — Xu Mei
(74) *Attorney, Agent, or Firm* — Sherman IP LLP; Kenneth L. Sherman; Hemavathy Perumal

(57) ABSTRACT

One embodiment provides a speaker device comprising a first housing including a first top surface comprising a first opening, a first recessed mounting surface spaced below the first opening, and a first recessed sidewall extending upwardly from the first recessed mounting surface to the first opening to form a first waveguide. The speaker device further comprises a first upward-facing driver mounted into the first recessed mounting surface. The first waveguide shapes propagation of acoustic energy generated by the first upward-facing driver to project the acoustic energy out of the speaker device in an upwardly inclined direction.

20 Claims, 36 Drawing Sheets

(58) Field of Classification Search
USPC ..... 381/305, 306, 308, 87, 322, 335, 336, 381/337, 338, 339; 181/148, 154, 155, 181/198, 199, 152, 153, 177, 192
See application file for complete search history.

(56) References Cited

U.S. PATENT DOCUMENTS

| | | | | |
|---|---|---|---|---|
| 5,400,407 | A * | 3/1995 | Cassity | H04R 1/025 181/150 |
| 5,471,018 | A * | 11/1995 | Nieuwendijk | H04B 1/08 181/152 |
| 5,546,468 | A * | 8/1996 | Beard | B60R 11/0217 181/145 |
| 6,665,412 | B1 | 12/2003 | Mizoguchi | |
| 7,333,626 | B2 * | 2/2008 | Opie | H04R 1/26 181/144 |
| 8,041,061 | B2 | 10/2011 | Hughes et al. | |
| 8,170,263 | B2 | 5/2012 | Engebretson et al. | |
| 8,515,102 | B1 * | 8/2013 | Waller | H04R 1/24 181/145 |
| 8,971,542 | B2 | 3/2015 | Lau et al. | |
| 9,271,083 | B2 | 2/2016 | Kumakura | |
| 9,326,061 | B2 | 4/2016 | Kim et al. | |
| 9,374,640 | B2 | 6/2016 | Starobin | |
| 9,571,923 | B2 * | 2/2017 | Spillmann | H04R 1/2803 |
| 9,894,433 | B2 * | 2/2018 | Bridge | H04R 1/345 |
| 2002/0118853 | A1 * | 8/2002 | Flentje | G10H 3/187 381/336 |
| 2003/0164263 | A1 | 9/2003 | Tracy | |
| 2005/0226454 | A1 * | 10/2005 | Lam | H04R 1/028 381/386 |
| 2007/0086615 | A1 * | 4/2007 | Cheney | H04R 1/345 381/338 |
| 2010/0119089 | A1 * | 5/2010 | Tracy | H04R 1/026 381/184 |
| 2011/0019862 | A1 | 1/2011 | Smith et al. | |
| 2011/0051937 | A1 | 3/2011 | Ma et al. | |
| 2014/0177883 | A1 | 6/2014 | Syed et al. | |
| 2014/0219491 | A1 | 8/2014 | Ludlum et al. | |
| 2014/0226824 | A1 | 8/2014 | Walsh et al. | |
| 2014/0294195 | A1 | 10/2014 | Perez et al. | |
| 2015/0110305 | A1 * | 4/2015 | Noro | H04R 9/06 381/162 |
| 2015/0195634 | A1 | 7/2015 | Garfio et al. | |
| 2015/0223002 | A1 | 8/2015 | Mehta et al. | |
| 2015/0264506 | A1 | 9/2015 | Balabanis et al. | |
| 2015/0373457 | A1 | 12/2015 | Asano et al. | |
| 2017/0105072 | A1 * | 4/2017 | Katsumata | H04R 7/12 |

FOREIGN PATENT DOCUMENTS

| | | | |
|---|---|---|---|
| WO | 2014036085 | A1 | 3/2014 |
| WO | 2015105788 | A1 | 7/2015 |
| WO | 2015167273 | A1 | 11/2015 |
| WO | 2015187714 | A1 | 12/2015 |

OTHER PUBLICATIONS

Yahama Corporation, Digital Sound Projector YSP-5600 Owner's Manual, 2016, pp. 1-110.
Yahama Corporation, Yahama YSP-5600 Features, 2016, pp. 1-6 [downloaded from https://usa.yamaha.com/products/audio_visual/sound_bar/ysp-5600/features.html#product-tabs on Jun. 29, 2016].
Alesis, Elevate 5 Powered Desktop Studio Speakers Features, 2016, pp. 1-4, [downloaded from http://www.alesis.com/products/legacy/elevate-5 on Oct. 18, 2017].
Samsung Electronics Co., Ltd., Samsung HW-K360 Wireless Audio Sound Bar User Manual, 2016, pp. 1-35.
SpeakerCraft, AIM7 Series Loudspeaker Owner's Manual, 2016, pp. 1-8.
Atlantic Technology, H-PAS PowerBar 235 Instruction Manual, 2016, pp. 1-16.
Vizio Inc., Model SB3821-C6 Quick Start Guide, 2016, pp. 1-28.
Zvox Audio, Zvox Soundbar SB400/SB500 Setup & Operation, 2016, pp. 1-2.
Definitive Technology, SoloCinema Studio Owner's Manual, 2016, pp. 1-18.
Polk, Omni SB1 Sound Bar System Owner's Manual, 2016, pp. 1-9.
Sony, HT-ST9—Soundbar Startup Guide, 2016, pp. 1-16.
International Search Report and Written Opinion dated Jul. 25, 2017 for International Application PCT/KR2017/004815 from Korean Intellectual Property Office, pp. 1-10, Republic of Korea.
Extended European Search Report dated Mar. 5, 2019 for European Application No. 17796371.7 from European Patent Office, pp. 1-9, Munich, Germany.
European Office Action dated Oct. 31, 2019 for European Application No. 17796371.7 from European Patent Office, pp. 1-7, Munich, Germany.

* cited by examiner

200

200

200

300

300

300

400A

400B

400C

400D

400E

400F

900

1000

WAVEGUIDE FOR A HEIGHT CHANNEL IN A SPEAKER

CROSS-REFERENCE TO RELATED APPLICATIONS

The present application claims priority to U.S. Provisional Patent Application No. 62/333,673, filed on May 9, 2016, hereby incorporated by reference in its entirety.

TECHNICAL FIELD

One or more embodiments relate generally to loudspeakers, and in particular, to a waveguide for a height channel in a speaker.

BACKGROUND

A loudspeaker reproduces audio when connected to a receiver (e.g., a stereo receiver, a surround receiver, etc.), a television (TV) set, a radio, a music player, an electronic sound producing device (e.g., a smartphone), video players, etc. A loudspeaker may comprise one or more height channels that forward most of the acoustic energy reproduced towards the ceiling.

SUMMARY

One embodiment provides a speaker device comprising a first housing including a first top surface comprising a first opening, a first recessed mounting surface spaced below the first opening, and a first recessed sidewall extending upwardly from the first recessed mounting surface to the first opening to form a first waveguide. The speaker device further comprises a first upward-facing driver mounted into the first recessed mounting surface. The first waveguide shapes propagation of acoustic energy generated by the first upward-facing driver to project the acoustic energy out of the speaker device in an upwardly inclined direction.

Another embodiment provides a method for producing a waveguide for a speaker device. The method comprises determining at least one waveguide property suitable for enhancing an amount of acoustic energy projected by an upward-facing driver of the speaker device in an upwardly inclined direction, and fabricating a housing of the speaker device based on the at least one waveguide property. The housing includes the waveguide defined by an opening included in a top surface of the housing, a recessed mounting surface of the housing spaced below the opening, and a recessed sidewall extending upwardly from the recessed mounting surface to the opening. The upward-facing driver is mounted into the recessed mounting surface. The waveguide shapes propagation of the acoustic energy to project the acoustic energy out of the speaker device in the upwardly inclined direction.

One embodiment provides a method for enhancing an amount of acoustic energy projected by an upward-facing driver of the speaker device in an upwardly inclined direction. The method comprises generating, utilizing the upward-facing driver, the acoustic energy, and shaping propagation of the acoustic energy utilizing a waveguide of the speaker device to project the acoustic energy out of the speaker device in the upwardly inclined direction. The waveguide is defined by an opening included in a top surface of a housing of the speaker device, a recessed mounting surface of the housing spaced below the opening, and a recessed sidewall extending upwardly from the recessed mounting surface to the opening. The upward-facing driver is mounted into the recessed mounting surface.

These and other features, aspects and advantages of the one or more embodiments will become understood with reference to the following description, appended claims and accompanying figures.

DETAILED DESCRIPTION

Figure 1A:
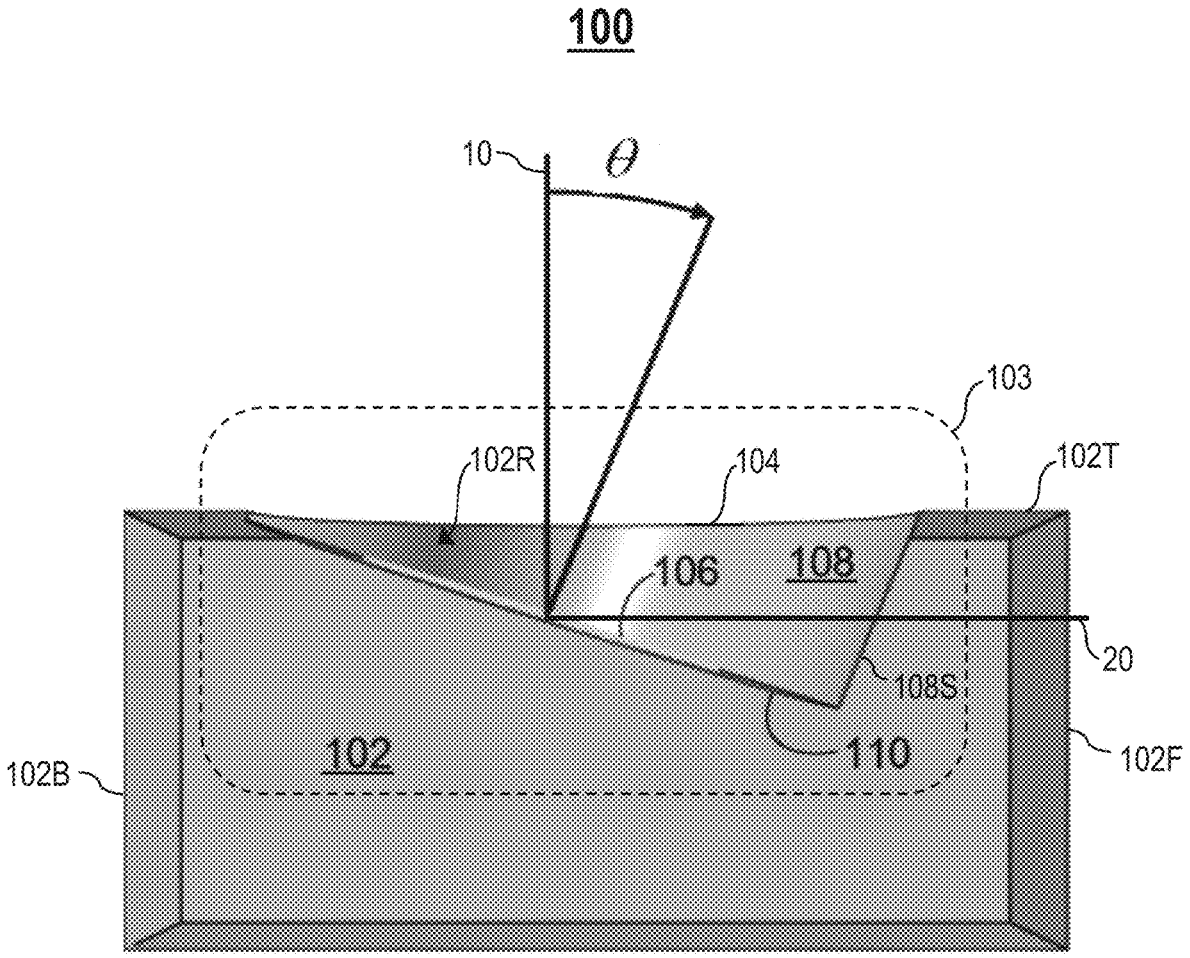
FIG. 1A illustrates a cross-section of a side view of an example height channel speaker in a speaker device, in accordance with one embodiment, in accordance with one embodiment.

The following description is made for the purpose of illustrating the general principles of one or more embodiments and is not meant to limit the inventive concepts claimed herein. Further, particular features described herein can be used in combination with other described features in each of the various possible combinations and permutations. Unless otherwise specifically defined herein, all terms are to be given their broadest possible interpretation including meanings implied from the specification as well as meanings understood by those skilled in the art and/or as defined in dictionaries, treatises, etc.

For expository purposes, the term "speaker device" as used herein generally refers to any type of audio speaker device/system. Examples of different types of audio speaker devices/systems include, but are not limited to, a loudspeaker, a soundbar, a subwoofer, or any other type of audio speaker device/system.

One or more embodiments relate generally to loudspeakers, and in particular, to a waveguide for a height channel in a speaker. One embodiment provides a speaker device comprising a first housing including a first top surface comprising a first opening, a first recessed mounting surface spaced below the first opening, and a first recessed sidewall extending upwardly from the first recessed mounting surface to the first opening to form a first waveguide. The speaker device further comprises a first upward-facing driver mounted into the first recessed mounting surface. The first waveguide shapes propagation of acoustic energy generated by the first upward-facing driver to project the acoustic energy out of the speaker device in an upwardly inclined direction.

Another embodiment provides a method for producing a waveguide for a speaker device. The method comprises determining at least one waveguide property suitable for enhancing an amount of acoustic energy projected by an upward-facing driver of the speaker device in an upwardly inclined direction, and fabricating a housing of the speaker device based on the at least one waveguide property. The housing includes the waveguide defined by an opening included in a top surface of the housing, a recessed mounting surface of the housing spaced below the opening, and a recessed sidewall extending upwardly from the recessed mounting surface to the opening. The upward-facing driver is mounted into the recessed mounting surface. The waveguide shapes propagation of the acoustic energy to project the acoustic energy out of the speaker device in the upwardly inclined direction.

One embodiment provides a method for enhancing an amount of acoustic energy projected by an upward-facing driver of the speaker device in an upwardly inclined direction. The method comprises generating, utilizing the upward-facing driver, the acoustic energy, and shaping propagation of the acoustic energy utilizing a waveguide of the speaker device to project the acoustic energy out of the speaker device in the upwardly inclined direction. The waveguide is defined by an opening included in a top surface of a housing of the speaker device, a recessed mounting surface of the housing spaced below the opening, and a recessed sidewall extending upwardly from the recessed mounting surface to the opening. The upward-facing driver is mounted into the recessed mounting surface.

Some speaker devices may comprise height channels, such as soundbars, front/surround/rear speakers outfitted with drivers for height channels, etc. Height channels in a speaker device aim sound generated by a sound source (e.g., transducer) of the speaker device at the ceiling (or other surface at a height above a listener or position from which sound is intended to be directed), allowing the sound to be reflected off the ceiling to create an impression of the sound coming from "above" the listener. One embodiment enhances an amount of acoustic energy directed towards the ceiling over an amount of acoustic energy towards a listener (i.e., leaked towards the listener instead of directed towards the ceiling).

Specification for Dolby Atmos speaker layouts require a driver of a height channel speaker to be structurally and acoustically occluded from a listener. The driver is acoustically occluded if a majority of acoustic energy coming from the height channel speaker is not directed to the listener via a direct path; instead the majority of the acoustic energy is directed towards the ceiling at an upwardly inclined direction that is substantially 70 degrees off a horizontal plane (i.e., substantially 20 degrees from a vertical plane), such that the majority of the acoustic energy reaches the listener via a reflection off the ceiling. The specification also requires a difference in sound level between sound towards the listener and sound reflected off the ceiling to be within a specified limit.

A conventional soundbar may utilize digital signal processing, such as beamforming, to direct sound from the soundbar towards the ceiling. A conventional height channel speaker may have height channels at a 20 degree inclined plane, the height channels having cylindrical wedge-like cutouts or simple square cutouts. Conventional height channel speakers typically produce a Directivity Index (DI) of a Height Listening Window (Height WDW) curve with peaks and dips in a critical frequency range of 1 kHz-8 kHz. Based on listening tests, listeners prefer speakers that have very smooth Directivity Index (DI) curves. A DI curve is characterized as a smooth DI curve if the curve exhibits one or more of the following properties: (1) the curve has less than a predefined number of peaks and/or dips, and/or (2) the curve has peaks and/or dips with slopes or derivatives that are (2a) within a predefined range, (2b) less than a predefined number, or (2c) greater than the predefined number. A speaker that has a smooth DI curve provides enhanced/improved sound quality.

One embodiment provides a waveguide that results in a very smooth DI curve. The waveguide satisfies requirements of the specification for Dolby Atmos speaker layouts. The waveguide structurally and acoustically occludes a driver from the listener, and enhances acoustic energy reflected off the ceiling. In one embodiment, the waveguide optimizes acoustic sound reflected off the ceiling. One embodiment provides a waveguide for a soundbar that begins at a 20 degree inclined plane in which a driver is mounted to a top plane of the soundbar to achieve a smooth DI Height WDW curve. The smooth DI Height WDW curve is psychoacoustically much superior to a DI Height WDW curve with peaks and dips for a conventional speaker device. In one example implementation, the waveguide has a horn-like shape, and the waveguide ends substantially tangentially at the top plane of the soundbar. In one example implementation, the waveguide has an elliptic exit shape at the top plane of the soundbar. Compared to conventional height channel speakers, the waveguide improves sound quality, improves sound perception, improves ratio of acoustic energy reflected from the ceiling to acoustic energy towards to the listener, and does not require digital signal processing.

FIG. 1A illustrates a cross-section of a side view of an example height channel speaker 103 in a speaker device 100, in accordance with one embodiment. The speaker device 100 comprises a speaker housing 102 including one or more sound sources (e.g., a speaker driver, etc.). Specifically, a top plane (i.e., a top surface) 102T of the speaker housing 102 comprises a height channel speaker 103. The height channel speaker 103 comprises an upward-facing speaker driver 106 (e.g., a tweeter, a woofer, etc.) disposed within a recessed area 102R of the top plane 102T. In one embodiment, the driver 106 lies flush inside the recessed area 102R.

The driver 106 is positioned/mounted axially in a recessed mounting surface 110 that defines a base of the recessed area 102R. Let 0 denote an angle of inclination of the driver 106 relative to a vertical axis 10 (i.e., an angle at which the recessed mounting surface 110 is inclined relative to the vertical axis 10). In one embodiment, the angle θ is in the range of 0 degrees to 60 degrees. In a preferred embodiment, the angle θ is about 20 degrees.

In one embodiment, the driver 106 is positioned in the mounting surface 110 at about a center of the mounting surface 110. In another embodiment, the driver 106 is positioned in the mounting surface 110 off-center (i.e., the driver 106 is positioned in the mounting surface 110 towards a top/bottom of the mounting surface 110).

One or more recessed sidewalls 108S of the recessed area 102R connecting the mounting surface 110 to the top plane 102T form a waveguide 108. In this example, the waveguide 108 is formed by a single recessed sidewall 108S. The waveguide 108 has an exit 104 defined as a cutout/opening in the top plane 102T where the recessed sidewalls 108S join/meet the top plane 102T. During operation of the speaker device 100, the waveguide 108 shapes propagation of acoustic energy reproduced by the driver 106 to project the acoustic energy out of the exit 104 in an upwardly inclined direction.

As described in detail later herein, a shape of the exit 104 may be circular, quadrilateral (e.g., a trapezoid, a square, a rectangle, etc.), elliptical, polygonal, or any other shape. A shape of the waveguide 108 may be straight or substantially curved (e.g., horn-shaped, cone-shaped, cup-shaped, etc.), depending on a shape of each recessed sidewall 108S. A waveguide may comprise one or more sidewall segments (e.g., straight, curved, etc.) that together form the waveguide. For example, a substantially curved waveguide may comprise a smooth curved segment, a number of straight segments that together form an approximately curved section, or a combination thereof.

In one embodiment, the top plane 102T is substantially parallel to a horizontal axis 20. In another embodiment, the top plane 102T is slanted or curved. A forward slanted top plane 102T decreases acoustical occlusion as a forward-facing part of the waveguide 108 is shortened. This reduces a ratio of acoustic energy reflected off the ceiling to acoustic energy leaked to a listener, thereby reducing perception of height in sound.

Figure 18A:
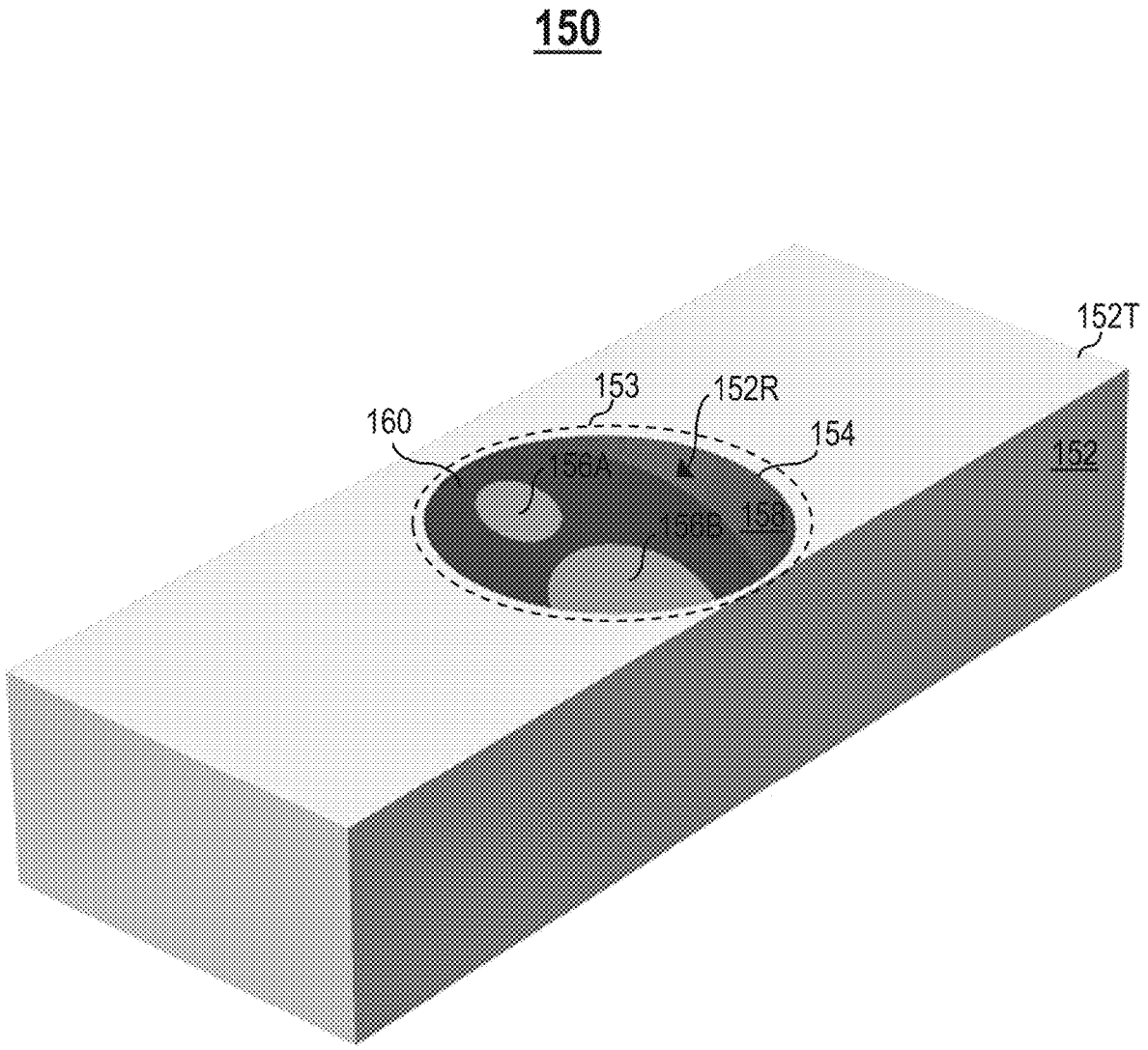
FIG. 18A illustrates a top view of an example height channel speaker in a speaker device, in accordance with one embodiment.
Figure 18B:
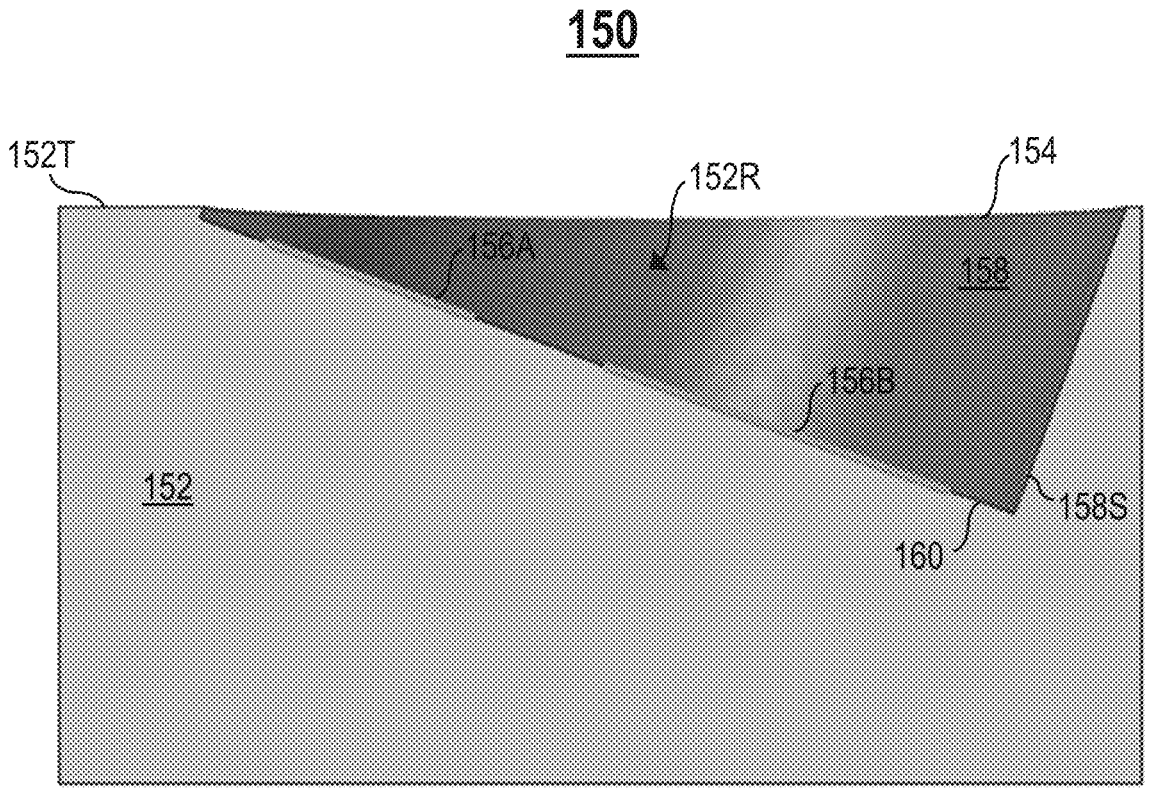
FIG. 18B illustrates a cross-section of a side view of the height channel speaker in a speaker device, in accordance with one embodiment.

In one embodiment, multiple drivers 106 may be positioned inside one waveguide 108 (see FIGS. 18A-18B).

In one embodiment, the exit 104 may have an asymmetric shape. For example, to steer acoustic energy laterally, a center of the exit 104 need not be located in the same vertical plane as a center of the driver 106.

Figure 6A:
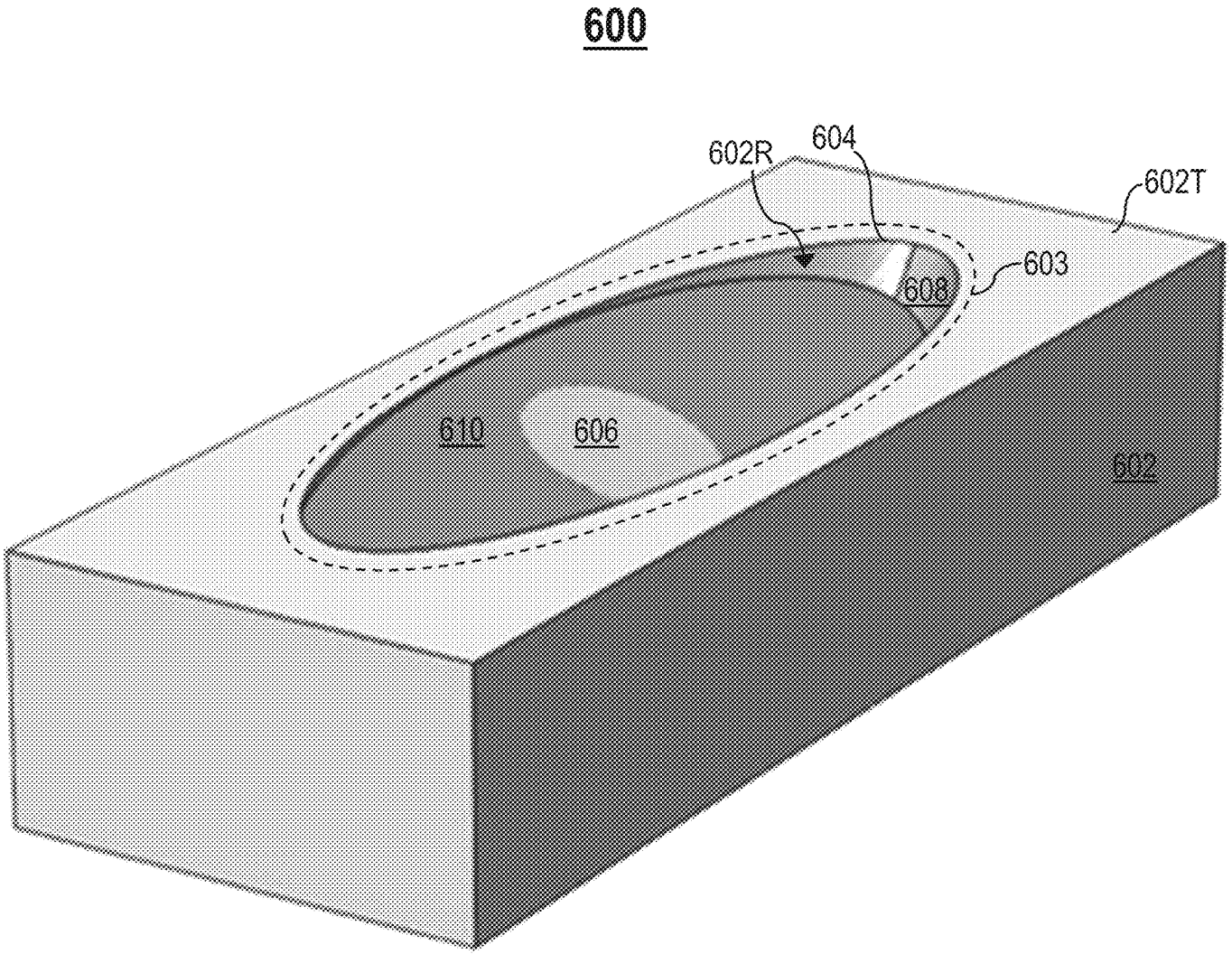
FIG. 6A illustrates a top, front perspective view of an example speaker device comprising a height channel speaker having a straight waveguide with an elliptical exit, in accordance with one embodiment.
Figure 11A:
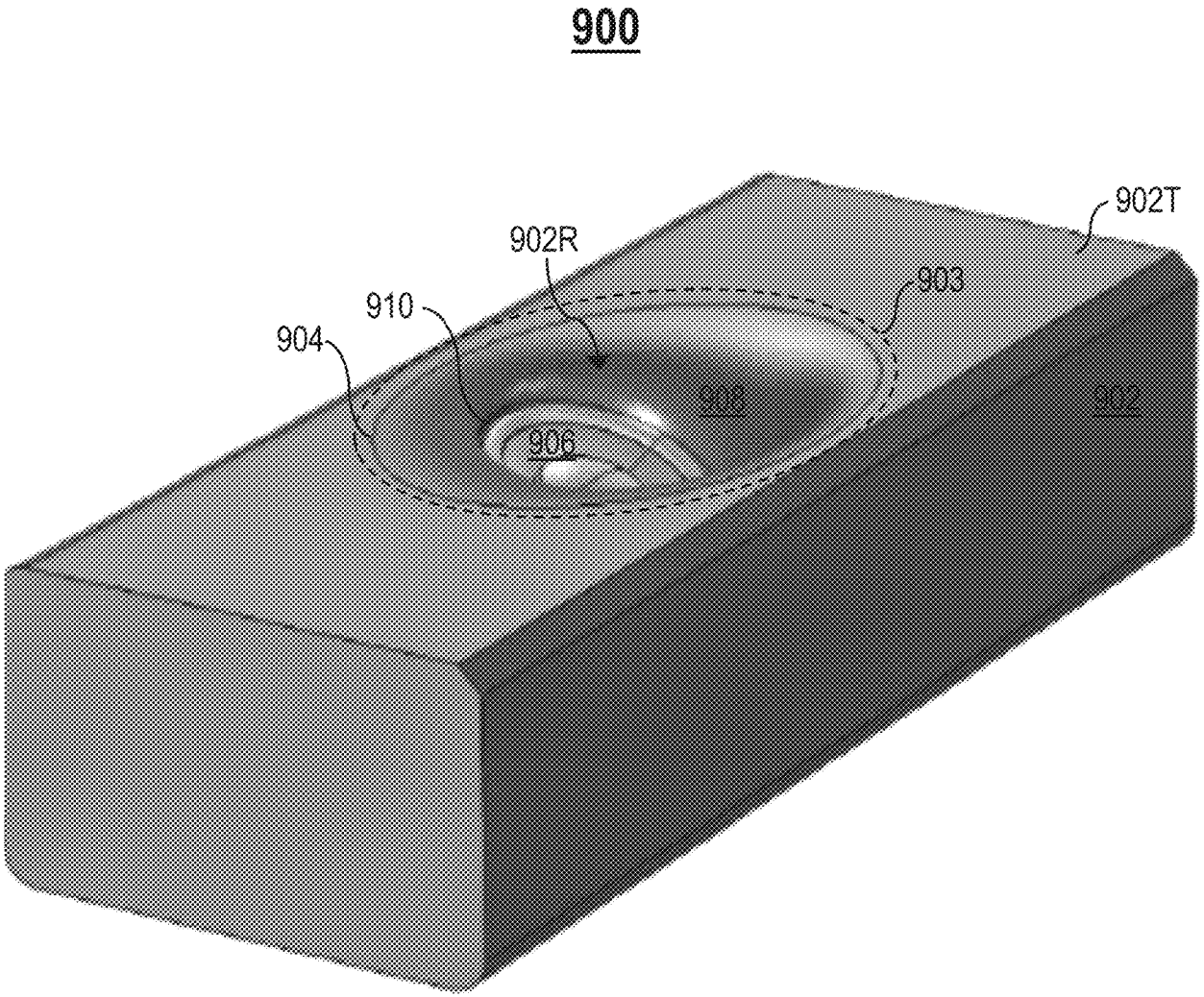
FIG. 11A illustrates a top, front perspective view of an example speaker device comprising a height channel speaker having a horn-shaped waveguide that smoothly transitions to an elliptical exit, in accordance with one embodiment.

In one embodiment, a shape of the mounting surface 110 may be circular, elliptical, or any other shape. In one embodiment, the mounting surface 110 may have the same shape as the exit 104 (e.g., both the mounting surface 110 and the exit 104 are elliptical, as shown in FIG. 6A). In another embodiment, the mounting surface 110 may have a different shape than the exit 104 (e.g., the mounting surface 110 is circular whereas the exit 104 is elliptical, as shown in FIG. 11A; other configurations are possible).

Figure 3A:
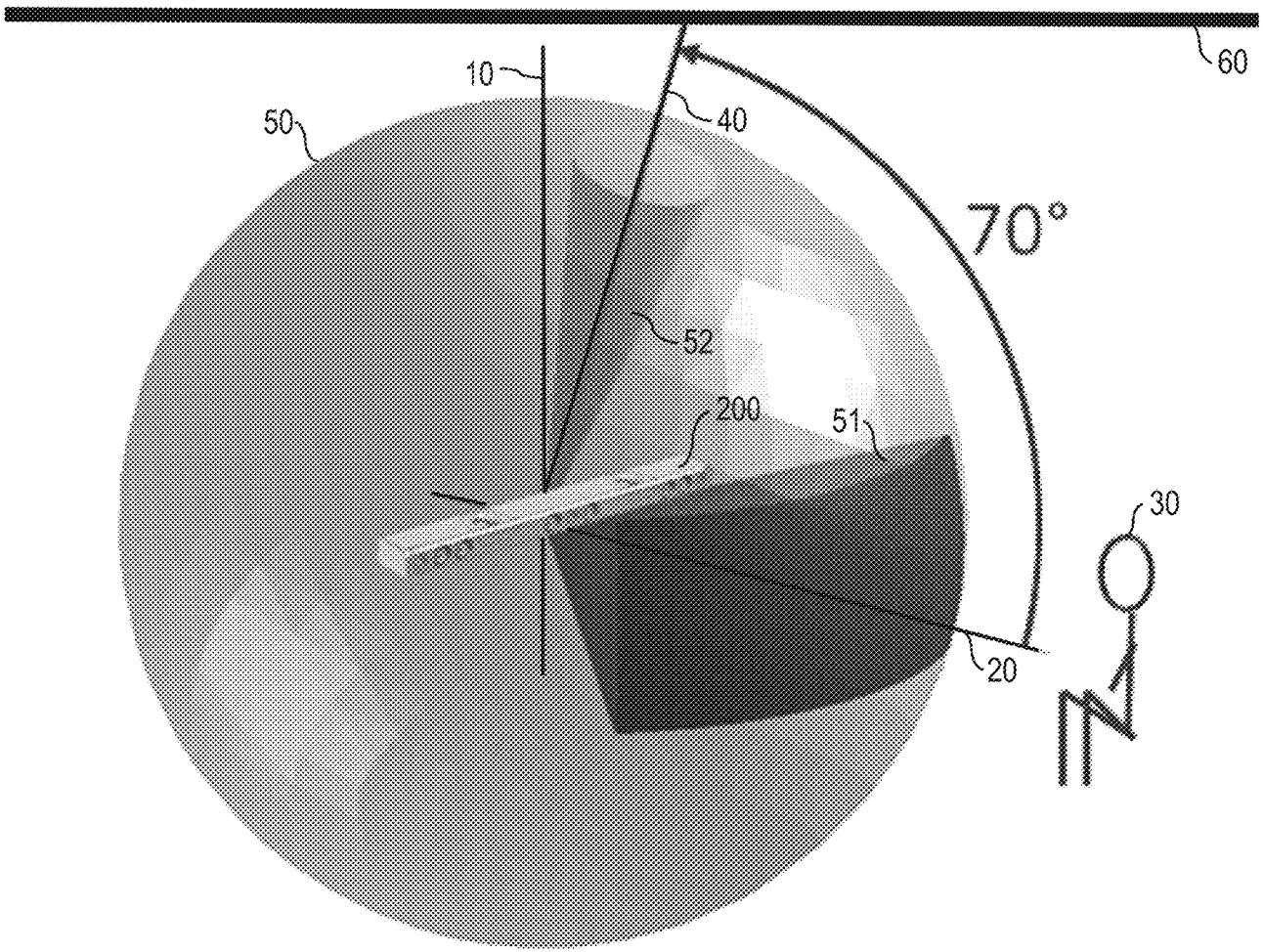
FIG. 3A illustrates different measures of sound quality of audio reproduced by the soundbar in FIG. 2A, in accordance with one embodiment.

In one embodiment, the speaker device 100 may have a preferred sound direction. As shown in FIG. 3A, the preferred sound direction may be towards a listener 30 (FIG. 3A) positioned in front of and within proximity of the speaker device 100. A front 102F of the speaker housing 102 is directed towards the preferred sound direction, whereas a back 102B of the speaker housing 102 is directed towards another direction that is opposite of the preferred sound direction.

In one embodiment, the speaker device 100 may comprise one or more additional speaker housings. An additional speaker housing may include a respective top surface comprising a respective opening, a respective recessed mounting surface spaced below the respective opening, and a respective recessed sidewall extending upwardly from the respective recessed mounting surface to the respective opening to form an additional waveguide. An additional upward-facing driver may be mounted into the respective recessed mounting surface of the additional speaker housing. The additional waveguide shapes propagation of acoustic energy generated by the additional upward-facing driver to project the acoustic energy out of the speaker device in an upwardly inclined direction. In one example implementation, respective shapes of the waveguide 108 and each additional waveguide are at least partially distinct (e.g., the same general shape but different sizes, or vice versa). In one example implementation, respective shapes of openings of the waveguide 108 and each additional waveguide are at least partially distinct.

Figure 1B:
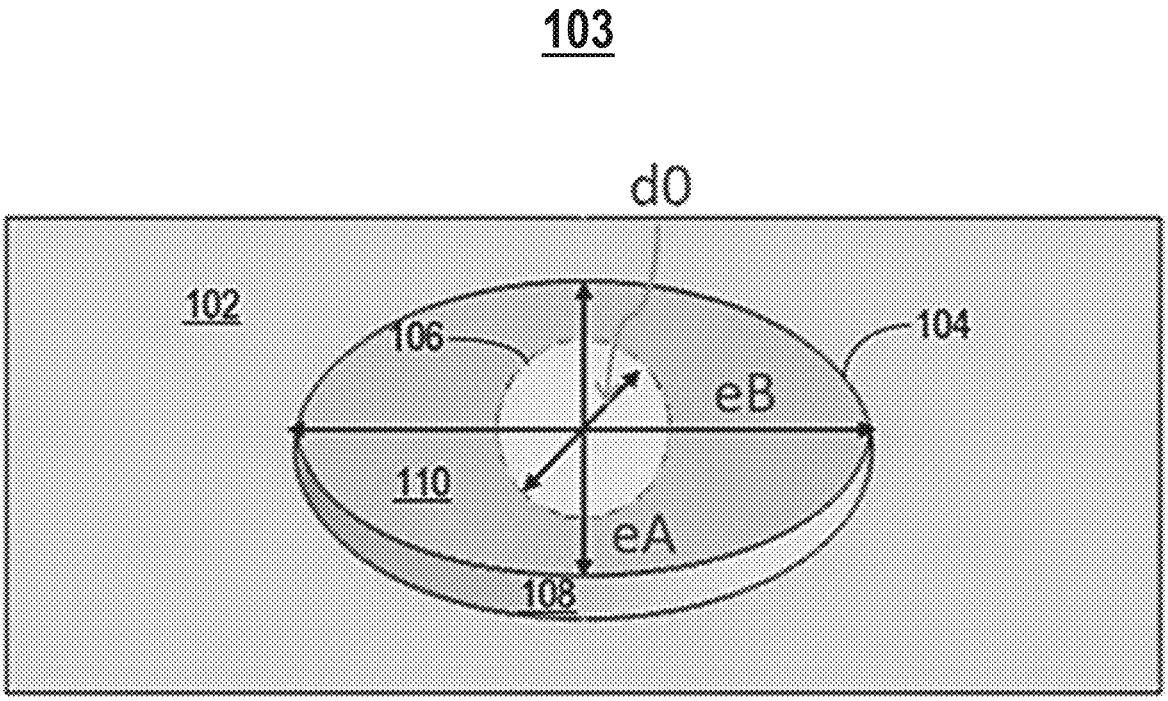
FIG. 1B illustrates a top view of the height channel speaker in FIG. 1A, in accordance with one embodiment.

FIG. 1B illustrates a top view of the height channel speaker 103, in accordance with one embodiment. Let d0 denote a diameter of the driver 106, let eA denote a minor radius of the exit 104, and let eB denote a major radius of the exit 104. If a shape of the exit 104 is circular, eA=eB. In one embodiment, if a shape of the exit 104 is elliptical, eB>eA. In another embodiment, if a shape of the exit 104 is elliptical, eB<eA.

In one embodiment, the diameter d0 is about 60 mm, the minor radius eA is about 50 mm, and the major radius eB is in the range of 50 mm to 150 mm, depending on a design or application of the speaker device 100.

In one embodiment, one or more parameters/properties of the height channel speaker 103 may be varied/configured to achieve a smooth DI curve. Example parameters/properties of the height channel speaker 103 include, but are not limited to, a shape of the exit 104, a shape of the waveguide 108, narrowness of the waveguide 108 at the base, depth of the recessed area 102R, etc. In one embodiment, a smooth DI curve is attainable without using other means (i.e., varying/configuring parameters/properties of the height channel speaker 103 is enough); examples of other means include, but are not limited to, adding materials to the height channel speaker 103 (e.g., foam material), using digital signal processing techniques, etc.

In one embodiment, the height channel speaker 103 may be incorporated into any type of speaker device, such as a soundbar in a home theater setup.

Figure 2A:
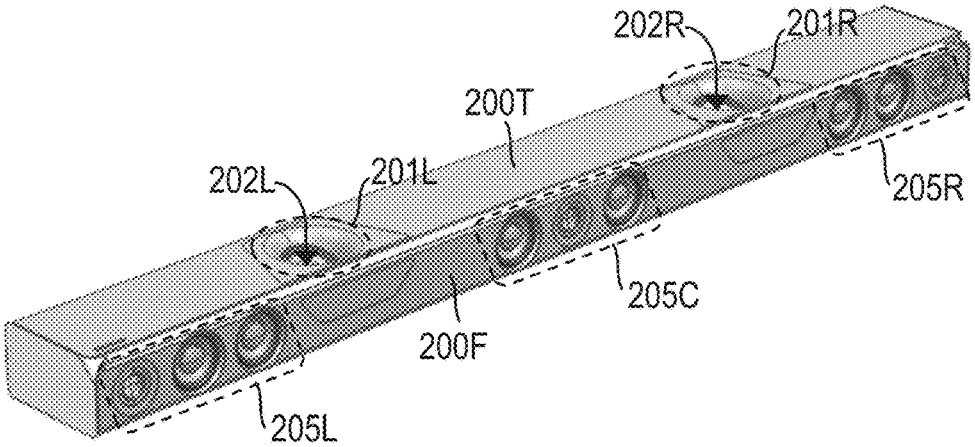
FIG. 2A illustrates a top, front perspective view of an example soundbar, in accordance with one embodiment.
Figure 2B:
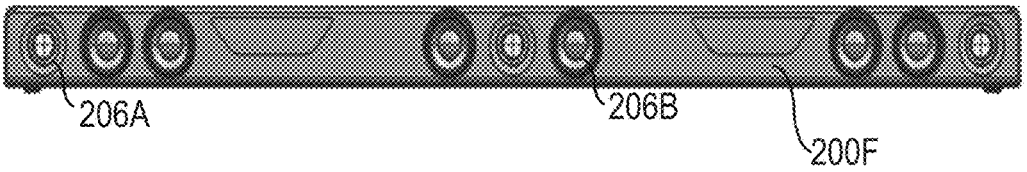
FIG. 2B illustrates a front view of the soundbar in FIG. 2A, in accordance with one embodiment.
Figure 2C:
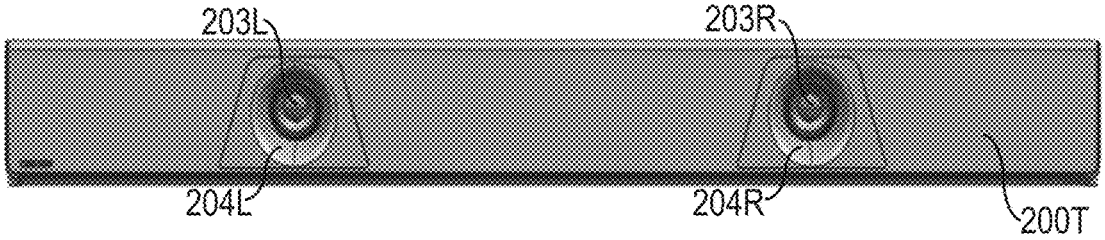
FIG. 2C illustrates a top view of the soundbar in FIG. 2A, in accordance with one embodiment.

FIG. 2A illustrates a top, front perspective view of an example soundbar 200, in accordance with one embodiment. FIG. 2B illustrates a front view of the soundbar 200 (which is one type of speaker, speaker device, speaker system, etc.), in accordance with one embodiment. FIG. 2C illustrates a top view of the soundbar 200, in accordance with one embodiment. As shown in FIGS. 2A and 2C, the soundbar 200 comprises a left height channel speaker 201L and a right height channel speaker 201R that are spaced apart on a top plane 200T of the soundbar 200. The top plane 200T is substantially parallel to the horizontal axis 20.

Each height channel speaker 201L, 201R is an example implementation of the height channel speaker 103 described above. The left height channel speaker 201L comprises a first upward-facing driver 203L disposed within a first recessed area 202L in the top plane 200T. One or more recessed sidewalls of the first recessed area 202L form a first waveguide 204L for shaping propagation of acoustic energy reproduced by the first upward-facing driver 203L to project the acoustic energy out of the soundbar 200 in an upwardly inclined direction. The right height channel speaker 201R comprises a second upward-facing driver 203R disposed within a second recessed area 202R in the top plane 200T. One or more recessed sidewalls of the second recessed area 202R form a second waveguide 204R for shaping propagation of acoustic energy reproduced by the second upward-facing driver 203R to project the acoustic energy out of the soundbar 200 in an upwardly inclined direction.

As further shown in FIGS. 2A and 2B, a front side 200F of the soundbar 200 comprises a first set 205L of forward-facing speakers for a left channel, a second set 205C of forward-facing speakers for a center channel, and a third set 205R of forward-facing speakers for a right channel. In one embodiment, each set 205L, 205C, and 205R comprises at least one tweeter 206A and at least one mid-base woofer 206B (e.g., two mid-base woofers and one tweeter). In another embodiment, each set 205L, 205C, and 205R comprises a single driver/transducer (i.e., a full range speaker).

In one embodiment, an exit of each waveguide 204L, 204R may have an asymmetric shape. For example, to steer acoustic energy laterally, a center of an exit of each waveguide 204L, 204R need not be located in the same vertical plane as a center of a driver 203L, 203R. A listener could perceive a wider sound image if an exit of the first waveguide 204L is shifted to the left of its base, and an exit of the second waveguide 204R is shifted to the right of its base.

FIG. 3A illustrates different measures of sound quality of audio reproduced by the soundbar 200, in accordance with one embodiment. Assume a geometrical shape such as a sphere 50 surrounding the soundbar 200, wherein a surface of the sphere 50 is centered on the soundbar 200, such that all points on the surface of the sphere 50 are an equal distance away from the soundbar 200. The soundbar 200 is positioned in front of and within proximity of a listener 30. A majority of acoustic energy reproduced by the upward-facing drivers 203L, 203R of the soundbar 200 is directed in an upwardly inclined direction towards a ceiling 60.

In this specification, let the term "listening window" (LSTWDW) generally refer to an area 51 of the sphere 50 that is located symmetrically around the vertical axis 10 and the horizontal axis 20. The listening window 51 covers physical positions that one or more listeners 30 are most likely to occupy in an environment surrounding the soundbar 200 (e.g., a home environment, etc.). Typically, most listeners 30 will occupy a space inside the listening window 51. The listening window 51 represents propagation of acoustic energy reproduced by the soundbar 200 towards one or more listeners 30. For example, a majority of acoustic energy reproduced by the sets 205L, 205C, 205R of forward-facing speakers of the soundbar 200 is directed towards the listener 30. The listening window 51 spans between −35 degrees to +35 degrees horizontally about the horizontal axis 20, and −15 degrees to +15 degrees vertically about the vertical axis 10.

In this specification, let the term "height window" generally refer to an area 52 of the sphere 50 that is located symmetrically around the vertical axis 10 and the horizontal axis 20. The height window 52 represents propagation of acoustic energy reproduced by the soundbar 200 in an upwardly inclined direction towards the ceiling 60; the acoustic energy are reflected off the ceiling 60, causing the listener 30 to perceive the acoustic energy as coming from the ceiling. The height window 52 may be a cone of about 10 degrees around an inclined axis 40 pointing in a direction about 70 degrees vertically above the horizontal axis 20.

In this specification, let the term "total sound power" generally refer to an average energy of sound pressure levels (SPL) measured on the entire sphere 50.

In this specification, let the term "height directivity index" generally refer to a ratio of sound power (in Watt units) averaged over the height window 52 in comparison to an amount of total sound power averaged over the entire sphere 50. As sound power is often expressed in decibel (dB) units (i.e., sound power levels), the height directivity index also refers to a difference between sound power levels (in dB units) averaged over the height window 52 and an amount of total sound power levels averaged over the entire sphere 50. The waveguides 204L, 204R of the soundbar 200 increases a difference between sound power levels averaged over the height window 52 and sound power levels average over the listening window 51, thereby causing the listener 30 to perceive sound as coming more from the ceiling 60.

In this specification, one or more of the following curves representing different measures of sound quality may be included in a graph illustrating sound power levels of audio reproduced by a speaker device over a frequency domain: (1) a sound power curve representing an amount of total sound power levels reproduced by the speaker device, (2) a listening window curve representing sound power levels averaged over a listening window for the speaker device, (3) a height window curve representing sound power levels averaged over a height window for the speaker device, (4) a height DI curve representing a height DI for the speaker device, (5) a difference curve representing a difference between sound power levels averaged over the height window and sound power levels averaged over the listening window, and (6) a specification ("spec") curve representing a pre-specified limit for a difference between sound power levels averaged over a height window for a speaker device and sound power levels averaged over a listening window for the speaker device.

In one embodiment, a pre-specified limit represented by a spec curve is specified in spec for Dolby Atmos speaker layouts. A speaker device receives Dolby certification if a difference between sound power levels averaged over a height window for the speaker device and sound power levels averaged over a listening window for the speaker device is always greater than the pre-specified limit.

Figure 3B:
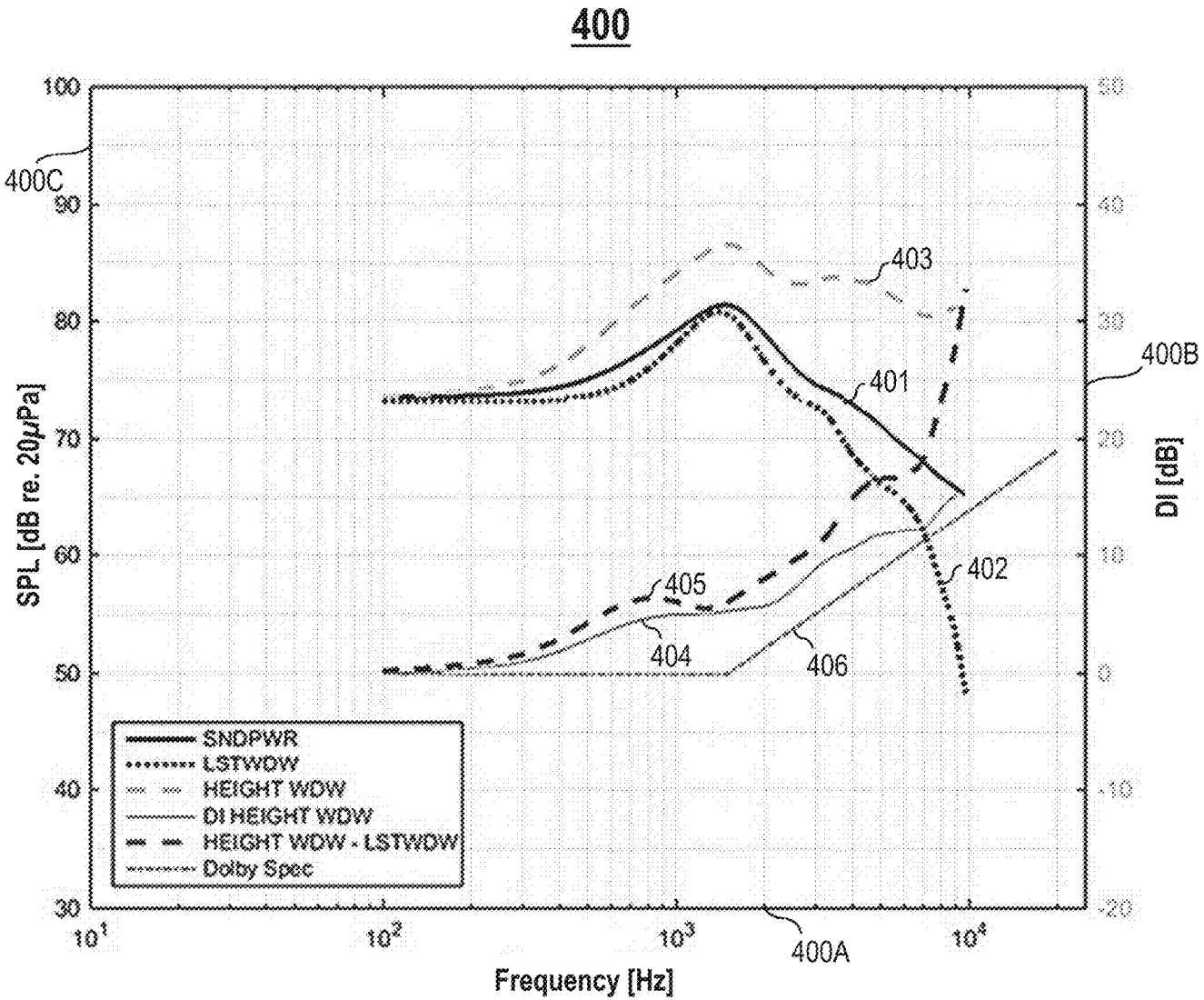
FIG. 3B is an example graph illustrating sound power levels of audio reproduced by the soundbar in FIG. 2A over a frequency domain, in accordance with one embodiment.

FIG. 3B is an example graph 400 illustrating sound power levels of audio reproduced by the soundbar 200 over a frequency domain, in accordance with one embodiment. The graph 400 comprises a sound power curve 401 ("SND-PWR"), a second listening window curve 402 ("LSTWDW"), a height window curve 403 ("HEIGHT WDW"), (4) a height DI curve 404 ("DI HEIGHT WDW"), a difference curve 405 ("HEIGHT WDW−LSTWDW"), and a spec curve 406 ("Dolby Spec"). A horizontal axis 400A represents frequency values of the frequency domain expressed in Hertz (Hz) units. A left vertical axis 400C represents sound power levels of the curves 401-403 expressed in dB units. A right vertical axis 400B represents sound power levels of the curves 404-406 expressed in dB units.

A smooth height DI curve over a frequency domain correlates with improved perception of sound by a listener 30. Any local dips or local peaks in a height DI curve correlates with a degradation in sound quality. If a listener 30 receives a majority of acoustic energy reproduced by a speaker device directly through a listening window rather than reflected off a ceiling through a height window, the listener 30 will not perceive sound as coming from above (e.g., from the ceiling). The listener 30 is more likely to perceive sound as coming from above (e.g., from the ceiling) if a difference between sound power levels averaged over the height window and sound power levels averaged over the listening window is increased.

In one embodiment, the speaker device 100 is implemented as a front, center, surround, or rear speaker in a home theater setup.

Figure 4A:
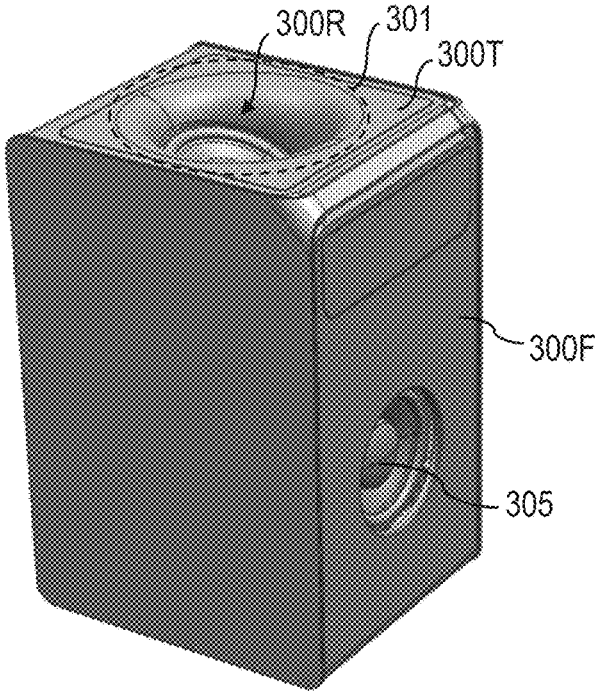
FIG. 4A illustrates a top, front perspective view of an example speaker device, in accordance with one embodiment.
Figure 4B:
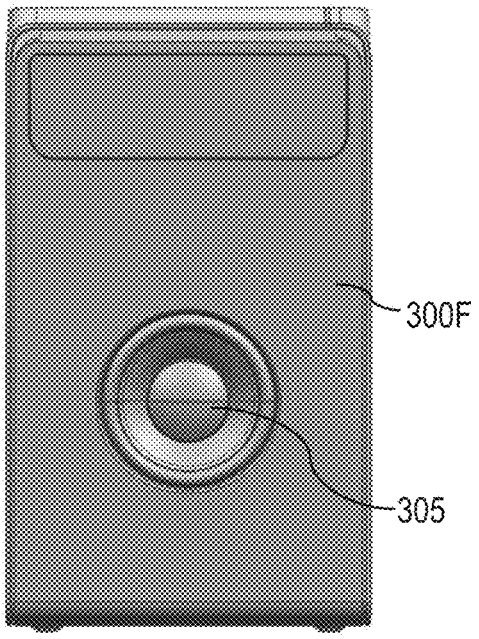
FIG. 4B illustrates a front view of the speaker device in FIG. 4A, in accordance with one embodiment.
Figure 4C:
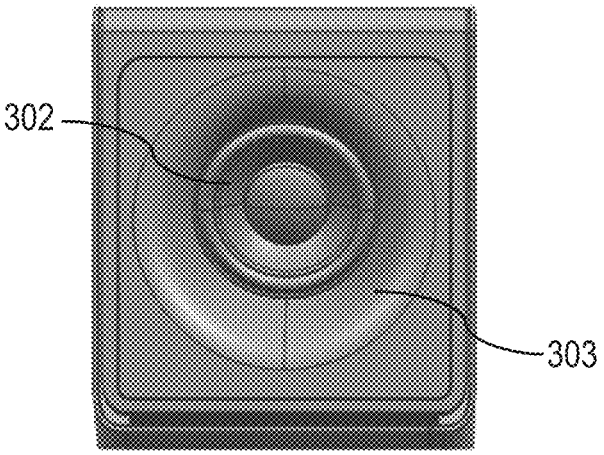
FIG. 4C illustrates a top view of the speaker device in FIG. 4A, in accordance with one embodiment.

FIG. 4A illustrates a top, front perspective view of an example speaker device 300, in accordance with one embodiment. FIG. 4B illustrates a front view of the speaker device 300, in accordance with one embodiment. FIG. 4C illustrates a top view of the speaker device 300, in accordance with one embodiment. The speaker device 300 may be utilized as a front, center, surround, or a rear speaker in a home theater setup. As shown in FIGS. 4A and 4C, a top plane 300T of the speaker device 300 comprises a height channel speaker 301. The top plane 300T is substantially parallel to the horizontal axis 20. The height channel speaker 301 is an example implementation of the height channel speaker 103 described above. The height channel speaker 301 comprises an upward-facing driver 302 disposed within a recessed area 300R in the top plane 300T. One or more recessed sidewalls of the recessed area 300R form a waveguide 303 for shaping propagation of acoustic energy reproduced by the driver 302 to project the acoustic energy out of the speaker device 300 in an upwardly inclined direction. In one embodiment, the waveguide 303 is formed by combining multiple recessed sidewalls. In another embodiment, the waveguide 303 is formed by a single recessed sidewall.

As further shown in FIGS. 4A and 4B, a front side 300F of the speaker device 300 comprises one or more forward-facing speakers 305 (e.g., at least one mid-base woofer and/or at least one tweeter).

Figure 5A:
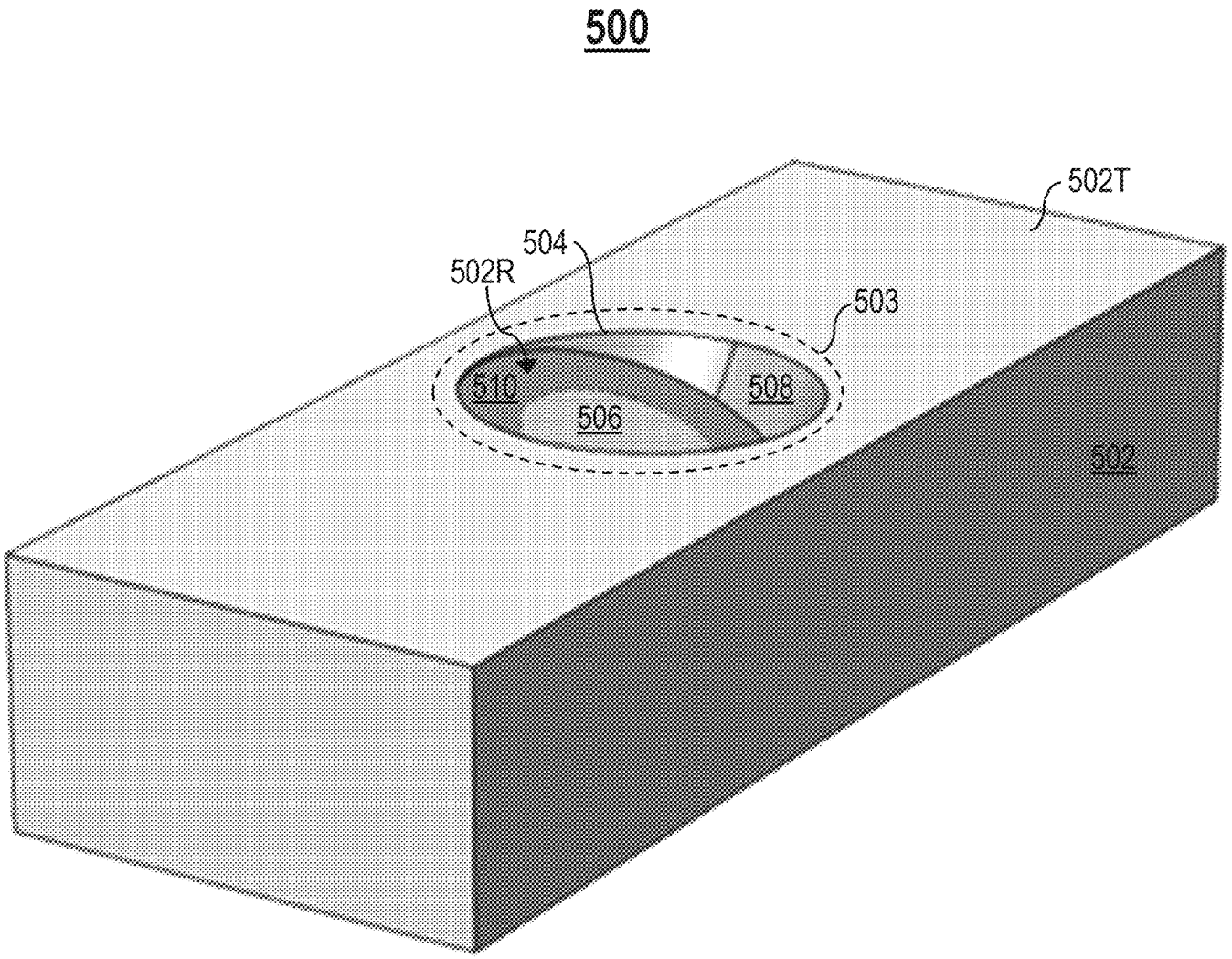
FIG. 5A illustrates a top, front perspective view of an example speaker device comprising a height channel speaker having a straight waveguide with a circular exit, in accordance with one embodiment.

FIG. 5A illustrates a top, front perspective view of an example speaker device 500 comprising a height channel speaker 503 having a straight waveguide 508 with a circular exit 504, in accordance with one embodiment. The speaker device 500 comprises a speaker housing 502 including one or more sound sources. Specifically, a top plane (i.e., a top surface) 502T of the speaker housing 502 comprises a height channel speaker 503. The top plane 502T is substantially parallel to the horizontal axis 20. The height channel speaker 503 comprises an upward-facing speaker driver 506 disposed within a recessed area 502R of the top plane 502T. In one embodiment, the driver 506 lies flush inside the recessed area 502R.

The driver 506 is positioned/mounted axially in a recessed mounting surface 510 that defines a base of the recessed area 502R.

One or more recessed sidewalls of the recessed area 502R comprises one or more straight walls connecting the mounting surface 510 to the top plane 502T form a straight waveguide 508. The straight waveguide 508 has circular exit 504 defined as a circular cutout/opening in the top plane 502T where the recessed sidewalls join/meet the top plane 502T. As the recessed sidewalls are straight, the recessed sidewalls form an edge at the circular exit 504. During operation of the speaker device 500, the waveguide 508 shapes propagation of acoustic energy reproduced by the driver 506 to project the acoustic energy out of the circular exit 504 in an upwardly inclined direction.

Figure 5B:
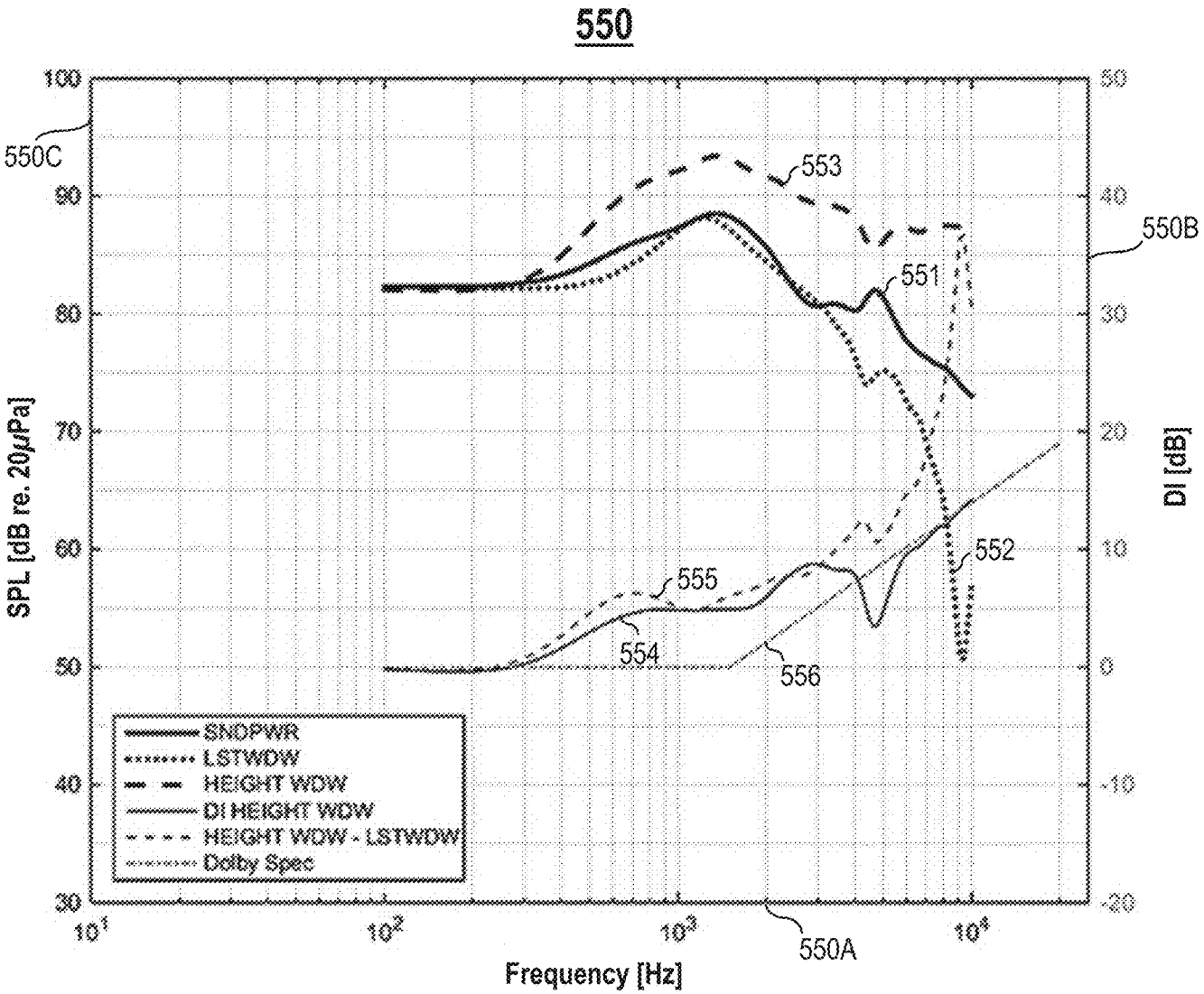
FIG. 5B is an example graph illustrating sound power levels of audio reproduced by the speaker device in FIG. 5A over a frequency domain, in accordance with one embodiment.

FIG. 5B is an example graph 550 illustrating sound power levels of audio reproduced by the speaker device 500 over a frequency domain, in accordance with one embodiment. The graph 550 comprises a sound power curve 551, a listening window curve 552, a height window curve 553, a height DI curve 554, a difference curve 555, and a spec curve 556. A horizontal axis 550A represents frequency values of the frequency domain expressed in Hz units. A left vertical axis 550C represents sound power levels of the curves 551-553 expressed in dB units. A right vertical axis 550B represents sound power levels of the curves 554-556 expressed in dB units.

As shown in FIG. 5B, the height DI curve 554 exhibits a substantially large dip at about 6 kHz frequency, which may be undesirable in certain circumstances.

FIG. 6A illustrates a top, front perspective view of an example speaker device 600 comprising a height channel speaker 603 having a straight waveguide 608 with an elliptical exit 604, in accordance with one embodiment. The speaker device 600 comprises a speaker housing 602 including one or more sound sources. Specifically, a top plane (i.e., a top surface) 602T of the speaker housing 602 comprises a height channel speaker 603. The top plane 602T is substantially parallel to the horizontal axis 20. The height channel speaker 603 comprises an upward-facing speaker driver 606 disposed within a recessed area 602R of the top plane 602T. In one embodiment, the driver 606 lies flush inside the recessed area 602R.

The driver 606 is positioned/mounted axially in a recessed mounting surface 510 that defines a base of the recessed area 602R.

One or more recessed sidewalls of the recessed area 602R comprises one or more straight walls connecting the mounting surface 610 to the top plane 602T form a straight waveguide 608. The straight waveguide 608 has an elliptical exit 604 defined as an elliptical cutout/opening in the top plane 602T where the recessed sidewalls join/meet the top plane 602T. As the recessed sidewalls are straight, the recessed sidewalls form an edge at the elliptical exit 604. During operation of the speaker device 600, the waveguide 608 shapes propagation of acoustic energy reproduced by the driver 606 to project the acoustic energy out of the elliptical exit 604 in an upwardly inclined direction.

Figure 6B:
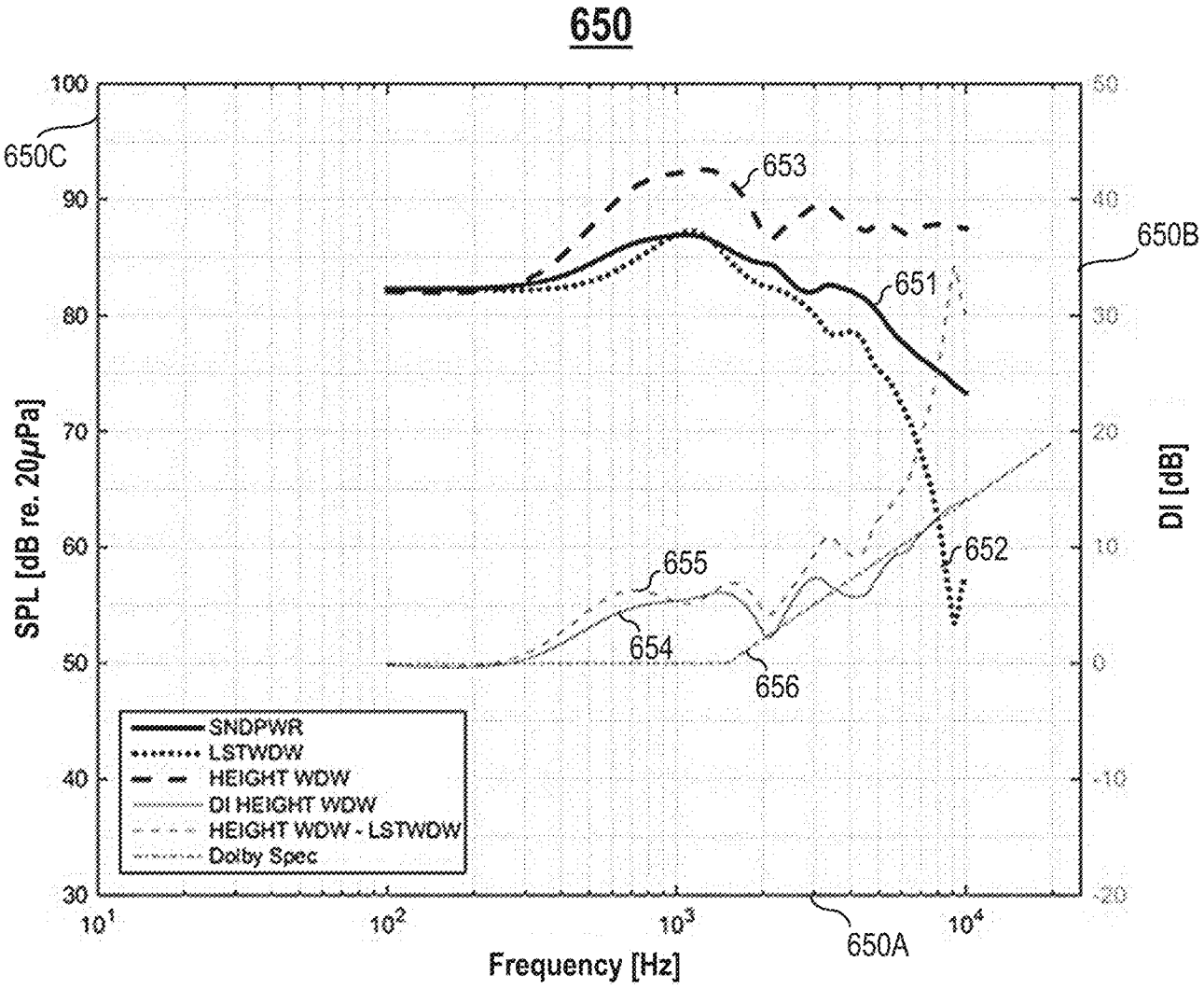
FIG. 6B is an example graph illustrating sound power levels of audio reproduced by the speaker device in FIG. 6A over a frequency domain, in accordance with one embodiment.

FIG. 6B is an example graph 650 illustrating sound power levels of audio reproduced by the speaker device 600 over a frequency domain, in accordance with one embodiment. The graph 650 comprises a sound power curve 651, a listening window curve 652, a height window curve 653, a height DI curve 654, a difference curve 655, and a spec curve 656. A horizontal axis 650A represents frequency values of the frequency domain expressed in Hz units. A left vertical axis 650C represents sound power levels of the curves 651-653 expressed in dB units. A right vertical axis 650B represents sound power levels of the curves 654-656 expressed in dB units.

Compared to the speaker device 600, the height DI curve 654 exhibits relatively smaller dips, indicating that the speaker device 600 provides improved/enhanced sound quality.

In one embodiment, a waveguide of a speaker device may be horn-shaped, wherein a top portion (i.e., an ending portion) of the waveguide transitions to a top plate of the speaker device at an angle about an exit of the waveguide. Let a denote a tangency angle that a top portion of a waveguide of a speaker device forms with a top plate of the speaker device, such that the top portion of the waveguide ends substantially tangential to the top plate. In one embodiment, the waveguide ends substantially tangential to the top plate if the tangency angle $\alpha$ is less than about 45 degrees. In another embodiment, the waveguide ends substantially tangential to the top plate if the tangency angle $\alpha$ is less than about 30 degrees. In yet another embodiment, the waveguide ends substantially tangential to the top plate if the tangency angle $\alpha$ is less than about 15 degrees.

Figure 7A:
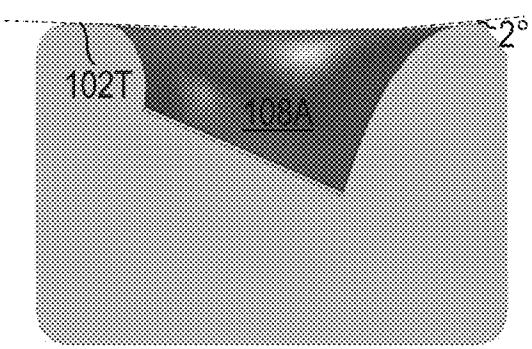
FIG. 7A illustrates a cross-section of an example horn-shaped waveguide that forms a tangency angle of about 2 degrees with a top plate, in accordance with one embodiment.
Figure 7B:
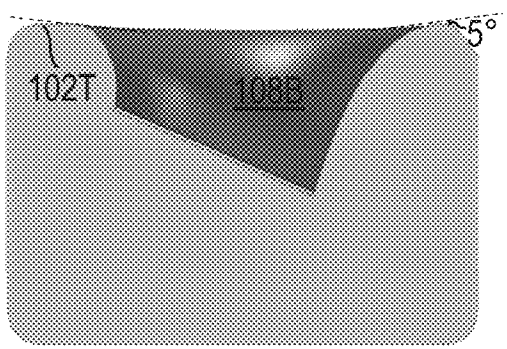
FIG. 7B illustrates a cross-section of an example horn-shaped waveguide that forms a tangency angle of about 5 degrees with a top plate, in accordance with one embodiment.
Figure 7C:
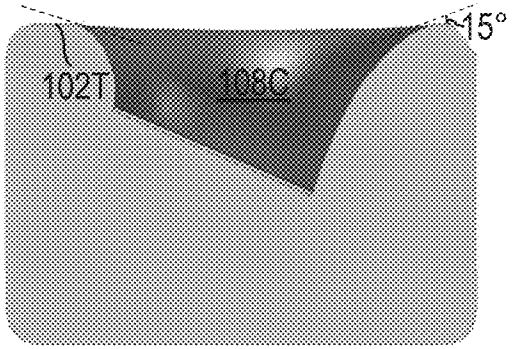
FIG. 7C illustrates a cross-section of an example horn-shaped waveguide that forms a tangency angle of about 15 degrees with a top plate, in accordance with one embodiment.
Figure 7D:
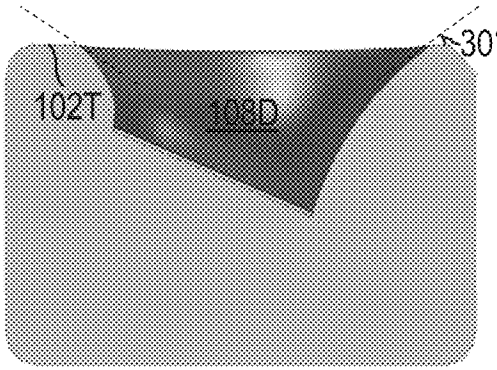
FIG. 7D illustrates a cross-section of an example horn-shaped waveguide that forms a tangency angle of about 30 degrees with a top plate, in accordance with one embodiment.
Figure 7E:
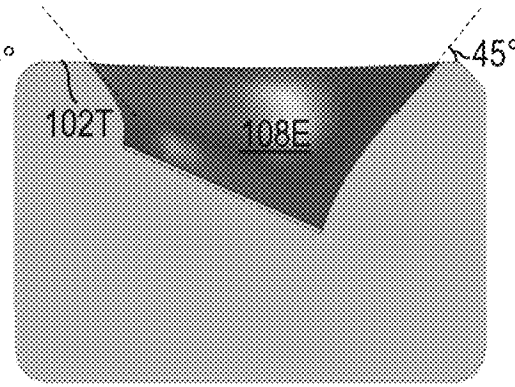
FIG. 7E illustrates a cross-section of an example horn-shaped waveguide that forms a tangency angle of about 45 degrees with a top plate, in accordance with one embodiment.
Figure 7F:
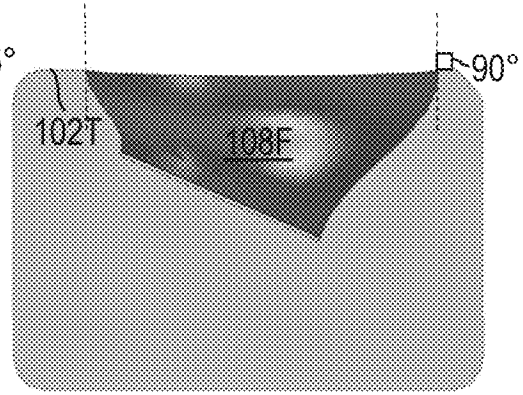
FIG. 7F illustrates a cross-section of an example horn-shaped waveguide that forms a tangency angle of about 90 degrees with a top plate, in accordance with one embodiment.

FIGS. 7A-7F illustrate different horn-shaped waveguides, in accordance with one or more embodiments. Specifically, FIG. 7A illustrates a cross-section of an example horn-shaped waveguide 108A that forms a tangency angle of about 2 degrees with a top plate 102T, in accordance with one embodiment. FIG. 7B illustrates a cross-section of an example horn-shaped waveguide 108B that forms a tangency angle of about 5 degrees with a top plate 102T, in accordance with one embodiment. FIG. 7C illustrates a cross-section of an example horn-shaped waveguide 108C that forms a tangency angle of about 15 degrees with a top plate 102T, in accordance with one embodiment. FIG. 7D illustrates a cross-section of an example horn-shaped waveguide 108D that forms a tangency angle of about 30 degrees with a top plate 102T, in accordance with one embodiment. FIG. 7E illustrates a cross-section of an example horn-shaped waveguide 108E that forms a tangency angle of about 45 degrees with a top plate 102T, in accordance with one embodiment. FIG. 7F illustrates a cross-section of an example horn-shaped waveguide 108F that forms a tangency angle of about 90 degrees with a top plate 102T, in accordance with one embodiment.

Figure 8A:
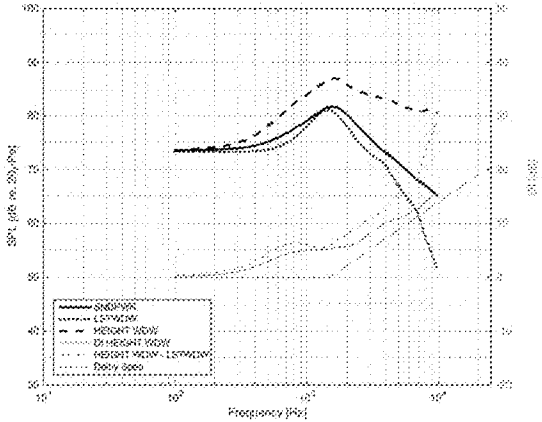
FIG. 8A is an example graph illustrating sound power levels projected by the waveguide in FIG. 7A over a frequency domain, in accordance with one embodiment.
Figure 8B:
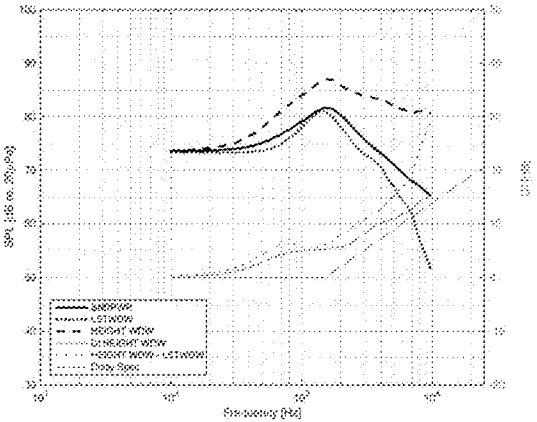
FIG. 8B is an example graph illustrating sound power levels projected by the waveguide in FIG. 7B over a frequency domain, in accordance with one embodiment.
Figure 8C:
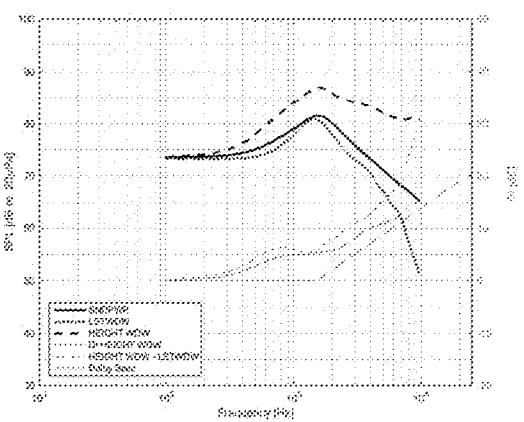
FIG. 8C is an example graph illustrating sound power levels projected by the waveguide in FIG. 7C over a frequency domain, in accordance with one embodiment.
Figure 8D:
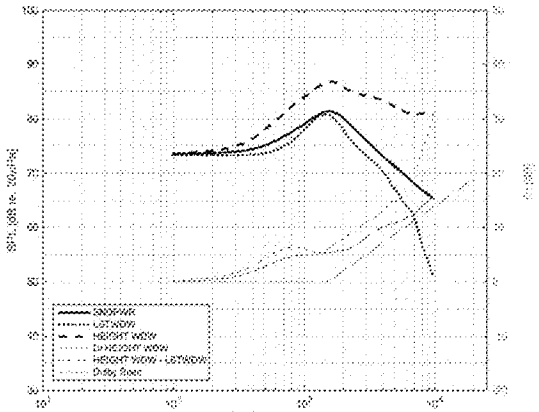
FIG. 8D is an example graph illustrating sound power levels projected by the waveguide in FIG. 7D over a frequency domain, in accordance with one embodiment.
Figure 8E:
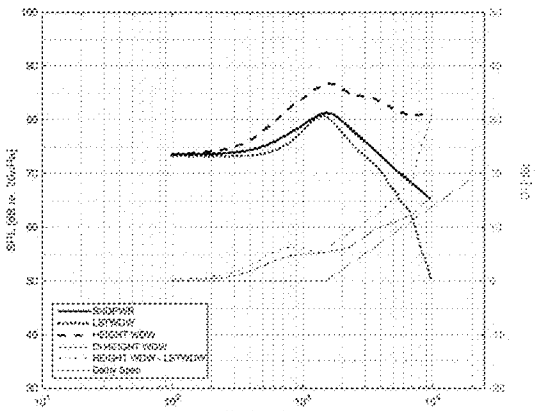
FIG. 8E is an example graph illustrating sound power levels projected by the waveguide in FIG. 7E over a frequency domain, in accordance with one embodiment.
Figure 8F:
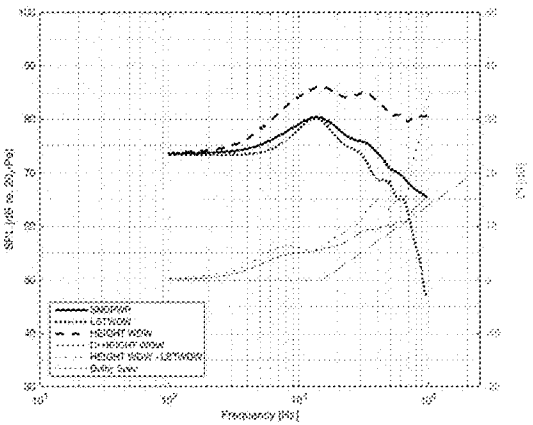
FIG. 8F is an example graph illustrating sound power levels projected by the waveguide in FIG. 7F over a frequency domain, in accordance with one embodiment.

FIGS. 8A-8F illustrate different graphs illustrating sound power levels projected by different waveguides with substantially curved shapes over a frequency domain, in accordance with one or more embodiments. FIG. 8A is an example graph 400A illustrating sound power levels projected by the waveguide 108A over a frequency domain, in accordance with one embodiment. FIG. 8B is an example graph 400B illustrating sound power levels projected by the waveguide 108B over a frequency domain, in accordance with one embodiment. FIG. 8C is an example graph 400C illustrating sound power levels projected by the waveguide 108C over a frequency domain, in accordance with one embodiment. FIG. 8D is an example graph 400D illustrating sound power levels projected by the waveguide 108D over a frequency domain, in accordance with one embodiment. FIG. 8E is an example graph 400E illustrating sound power levels projected by the waveguide 108E over a frequency domain, in accordance with one embodiment. FIG. 8F is an example graph 400F illustrating sound power levels projected by the waveguide 108F over a frequency domain, in accordance with one embodiment. Each graph 400A-400F comprises a sound power curve, a listening window curve, a height window curve, a height DI curve, a difference curve, and a spec curve.

In one embodiment, a tangency angle $\alpha$ formed between a top portion of a waveguide of a speaker device forms with a top plate of the speaker device is small enough to eliminate any drops in a height DI curve for the speaker device.

Small design or aesthetic features (e.g., steps, gaps, ribs, or other features less than 2 mm in size) included in a top portion of a waveguide or a top plate may be neglected when determining a tangency angle $\alpha$ between the waveguide and the top plate as these features do not alter sound quality significantly. Design or aesthetic features larger than 2 mm, however, may result in degradation of sound quality as these features obstruct/prevents the top portion of the waveguide from ending substantially tangential to the top plate.

In one embodiment, a shape of a waveguide for a height channel speaker has the following characteristics: (1) a bottom portion (i.e., a base) of the waveguide begins/starts close to an upward-facing driver of the height channel speaker (i.e., a mounting surface that the driver is positioned/mounted axially to is narrow, such that a diameter of the mounting surface is close to a diameter of the driver), and (2) a top portion of the waveguide smoothly transitions to a top plate of the height channel speaker, such that the top portion of the waveguide ends substantially tangential to the top plate.

Figure 9A:
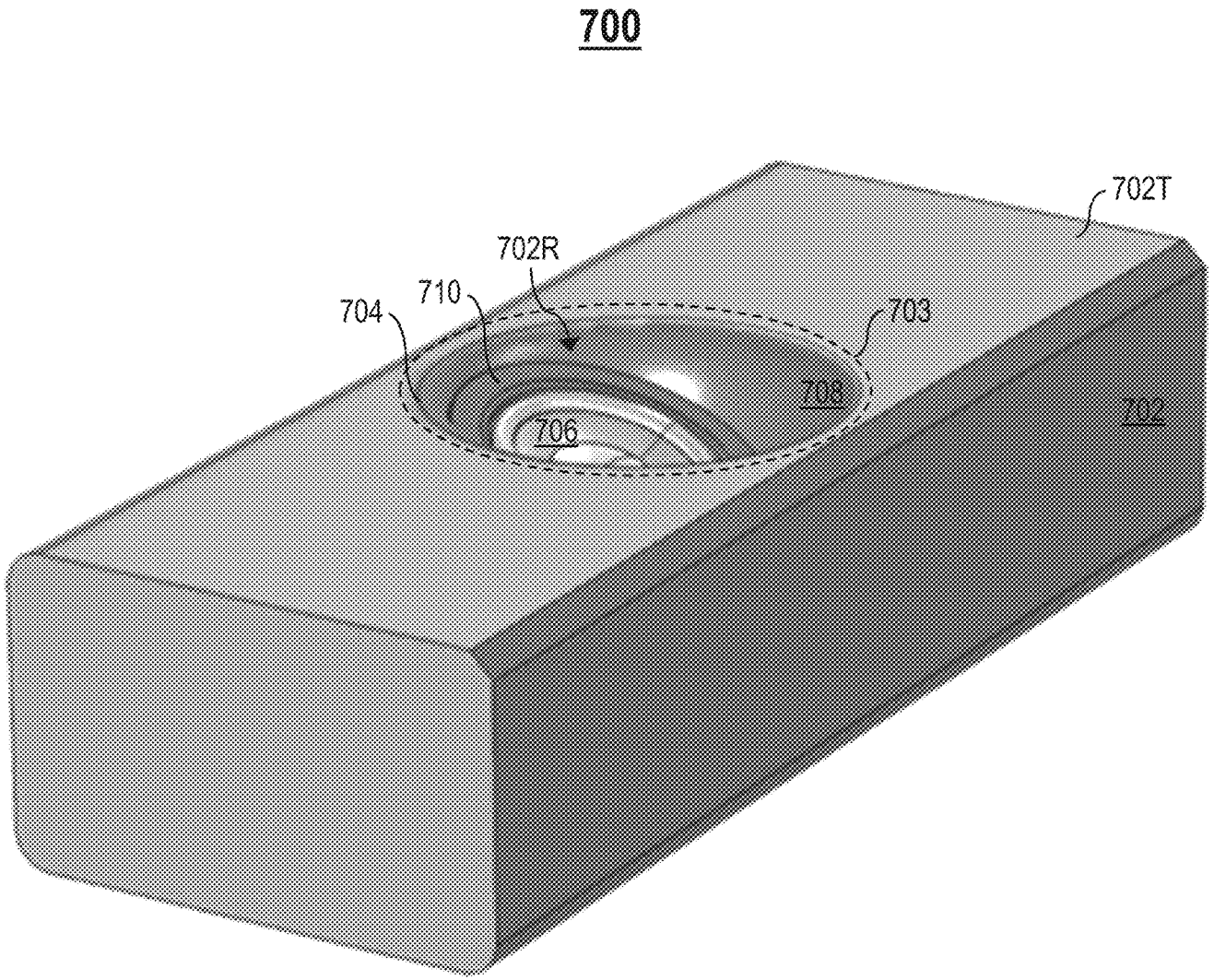
FIG. 9A illustrates a top, front perspective view of an example speaker device comprising a height channel speaker having a horn-shaped waveguide that smoothly transitions to a circular exit, in accordance with one embodiment.
Figure 9B:
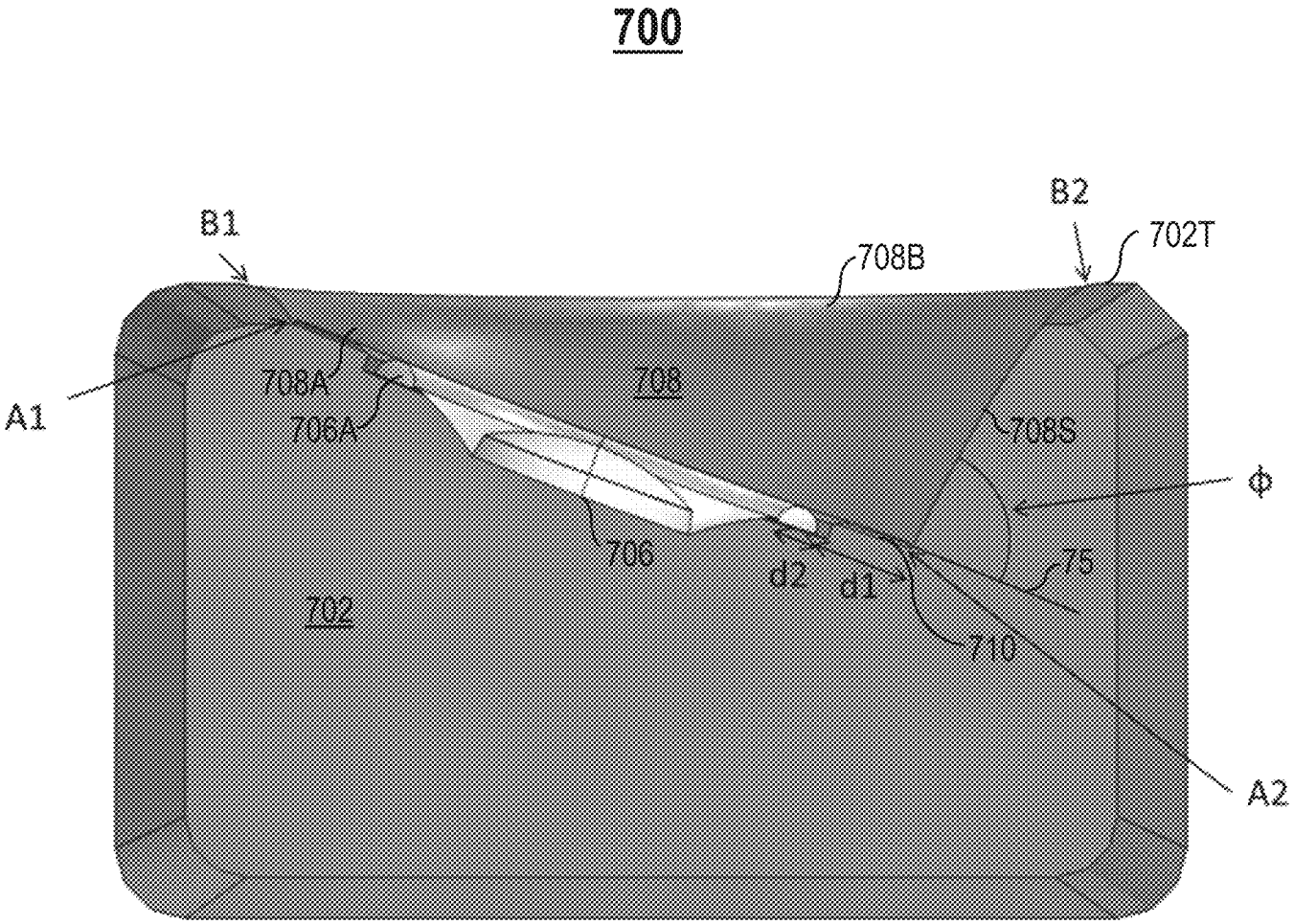
FIG. 9B illustrates a cross-section of a side view of the speaker device in FIG. 9A, in accordance with one embodiment.

FIG. 9A illustrates a top, front perspective view of an example speaker device 700 comprising a height channel speaker 703 having a horn-shaped waveguide 708 that smoothly transitions to a circular exit 704, in accordance with one embodiment. FIG. 9B illustrates a cross-section of a side view of the speaker device 700, in accordance with one embodiment. The speaker device 700 comprises a speaker housing 702 including one or more sound sources. Specifically, a top plane (i.e., a top surface) 702T of the speaker housing 702 comprises a height channel speaker 703. The top plane 702T is substantially parallel to the horizontal axis 20. The height channel speaker 703 comprises an upward-facing speaker driver 706 disposed within a recessed area 702R of the top plane 702T. In one embodiment, the driver 706 lies flush inside the recessed area 702R.

The driver 706 is positioned/mounted axially in a recessed mounting surface 710 that defines a base of the recessed area 702R. In one embodiment, the driver 706 has a surround suspension element 706A (i.e., an edge) that the mounting surface 710 is shaped to receive and engage with for maintaining the driver 706 within the recessed area 702R. For example, the surround suspension element 706A may comprise a surround roll.

One or more recessed sidewalls 708S of the recessed area 702R connecting the mounting surface 710 to the top plane 702T form a horn-shaped waveguide 708. The waveguide 708 has a circular exit 704 defined as a circular cutout/opening in the top plane 702T where the recessed sidewalls 708S join/meet the top plane 702T. The waveguide 708 smoothly ends at the circular exit 704. During operation of the speaker device 700, the waveguide 708 shapes propagation of acoustic energy reproduced by the driver 706 to project the acoustic energy out of the circular exit 704 in an upwardly inclined direction. A bottom portion 708A of the waveguide 708 begins at an upper point A1 and a lower point A2 along a plane 75 that is parallel to a diaphragm of the driver 706 (e.g., a plane inclined at 20 degrees from the horizontal axis). Let $\varphi$ denote an angle formed between a recessed sidewall of a recessed area (e.g., a recessed sidewall 708S) and the plane 75. In one embodiment, an angle $\varphi$ formed between a recessed sidewall 708S and the plane 75 is about 90 degrees.

Let d1 denote a distance between a recessed sidewall of a recessed area (e.g., a recessed sidewall 708S) and a surround suspension element (i.e., an edge of a driver, such as the surround suspension element 706A), and let d2 denote a diameter of the surround suspension element. As shown in FIG. 9B, a distance d1 between a recessed sidewall 708S and the surround suspension element 706A is substantially greater than a diameter d2 of the surround suspension element 706, thereby providing the waveguide 708 with a wide base that is distant from the driver 706. A top portion 708B of the waveguide 708 smoothly ends at the circular exit 704 at points B1 and B2 in the top plane 702T. The recessed sidewalls 708S end substantially tangential to the top plane 702T. The recessed sidewalls 708S transition smoothly and continually between the points A1 and A2 along the plane 75 and the points B1 and B2 in the top plane 702T.

In one embodiment, a diameter of a surround suspension element for a driver (e.g., the surround suspension element 706A) may be in the range of 2 mm to 20 mm (e.g., the diameter is smaller if the driver comprises a tweeter, the diameter is larger if the driver comprises a woofer, etc.). In one embodiment, to prevent local dips and peaks below 8 kHz resulting from a wide base, d1 is less than 3-4 mm.

In one embodiment, the base of the waveguide has a space d1 between the driver and the front wall of the waveguide.

Figure 9C:
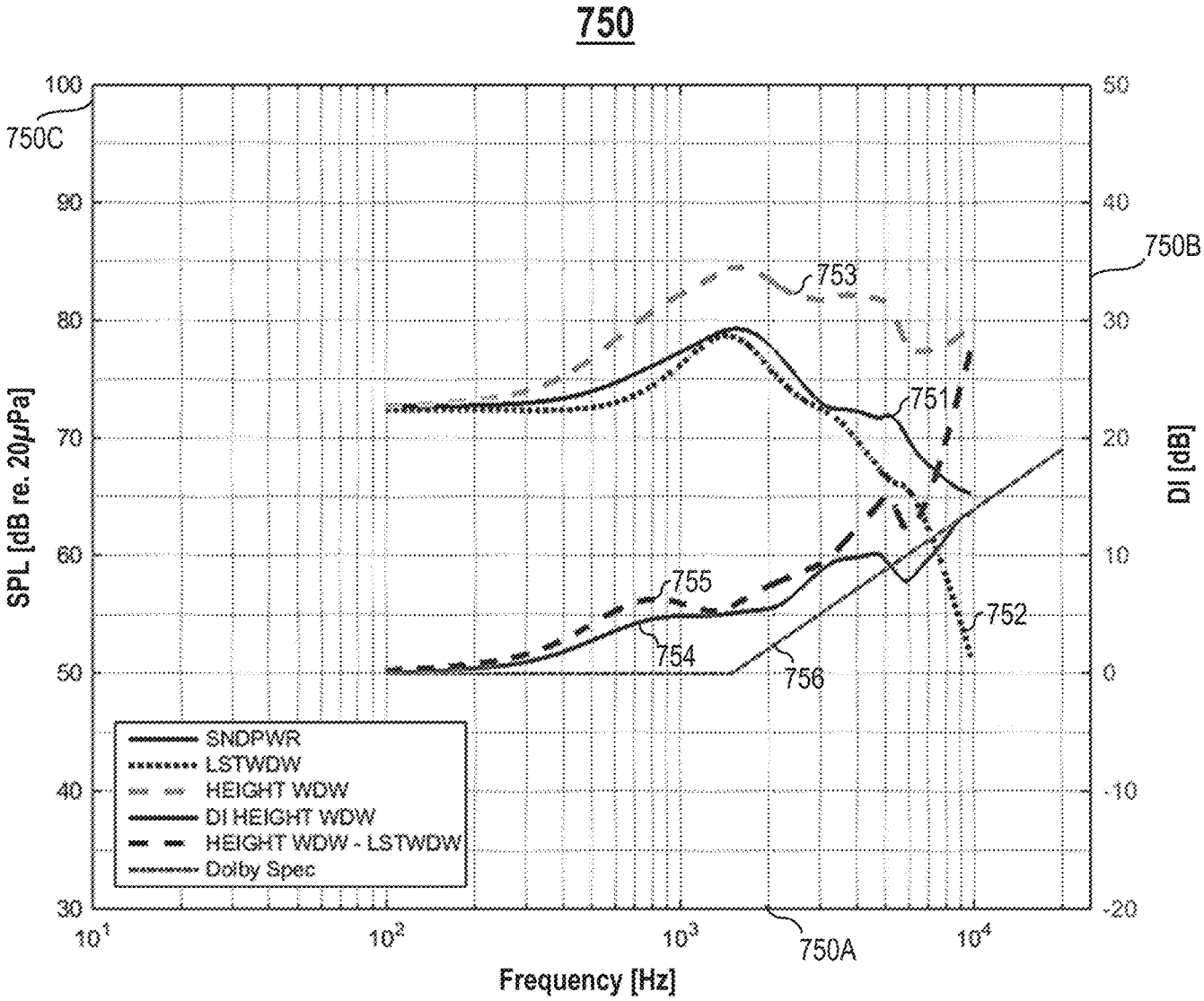
FIG. 9C is an example graph illustrating sound power levels of audio reproduced by the speaker device in FIG. 9A over a frequency domain, in accordance with one embodiment.

FIG. 9C is an example graph 750 illustrating sound power levels of audio reproduced by the speaker device 700 over a frequency domain, in accordance with one embodiment. The graph 750 comprises a sound power curve 751, a listening window curve 752, a height window curve 753, a height DI curve 754, a difference curve 755, and a spec curve 756. A horizontal axis 750A represents frequency values of the frequency domain expressed in Hz units. A left vertical axis 750C represents sound power levels of the curves 751-753 expressed in dB units. A right vertical axis 750B represents sound power levels of the curves 754-756 expressed in dB units.

As shown in FIG. 9C, the height DI curve 754 exhibits a dip between 5 kHz frequency and 7 kHz frequency, which may negatively influence perceived sound quality.

Figure 10A:
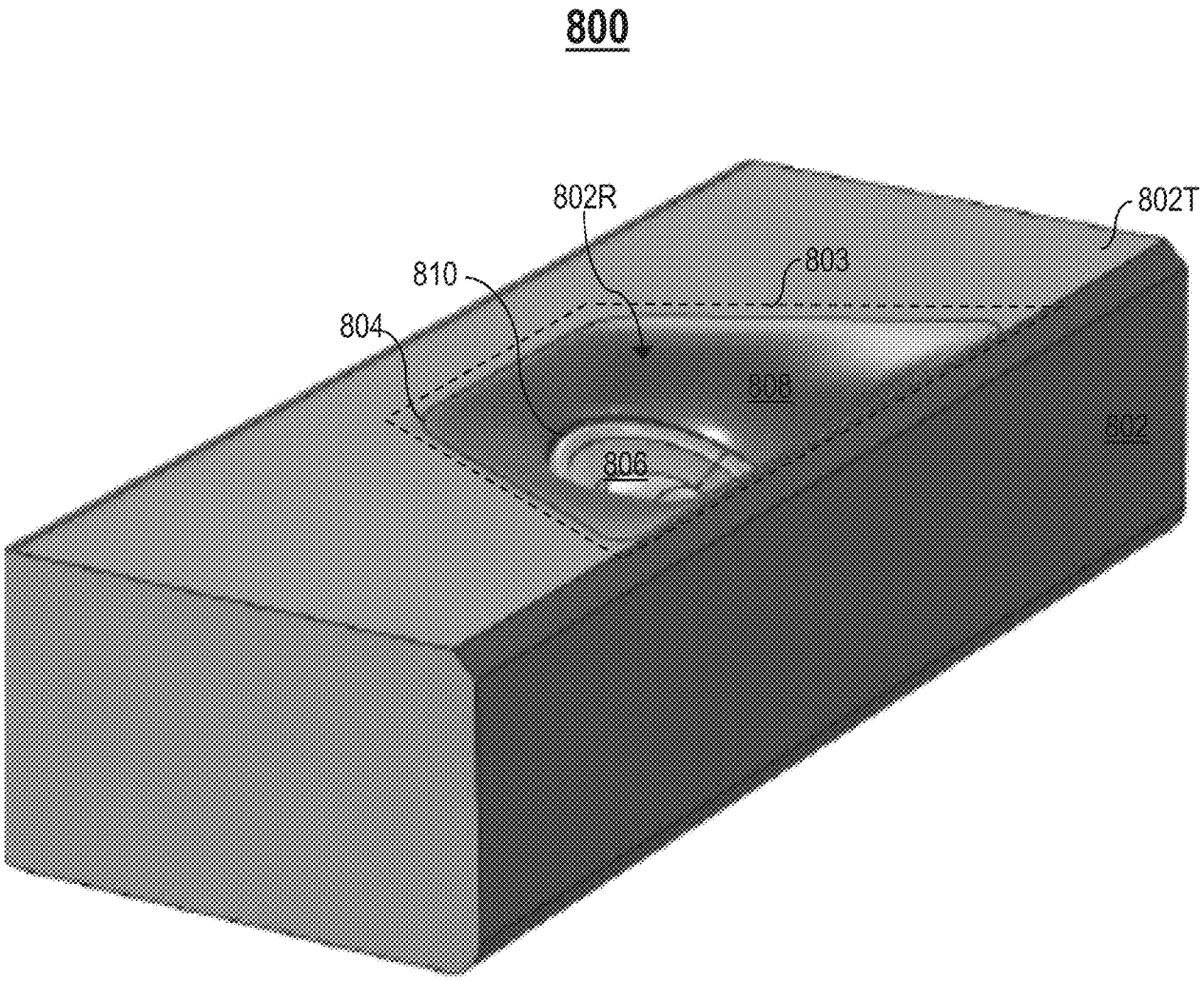
FIG. 10A illustrates a top, front perspective view of an example speaker device comprising a height channel speaker having a horn-shaped waveguide that smoothly transitions to a quadrilateral exit, in accordance with one embodiment.
Figure 10B:
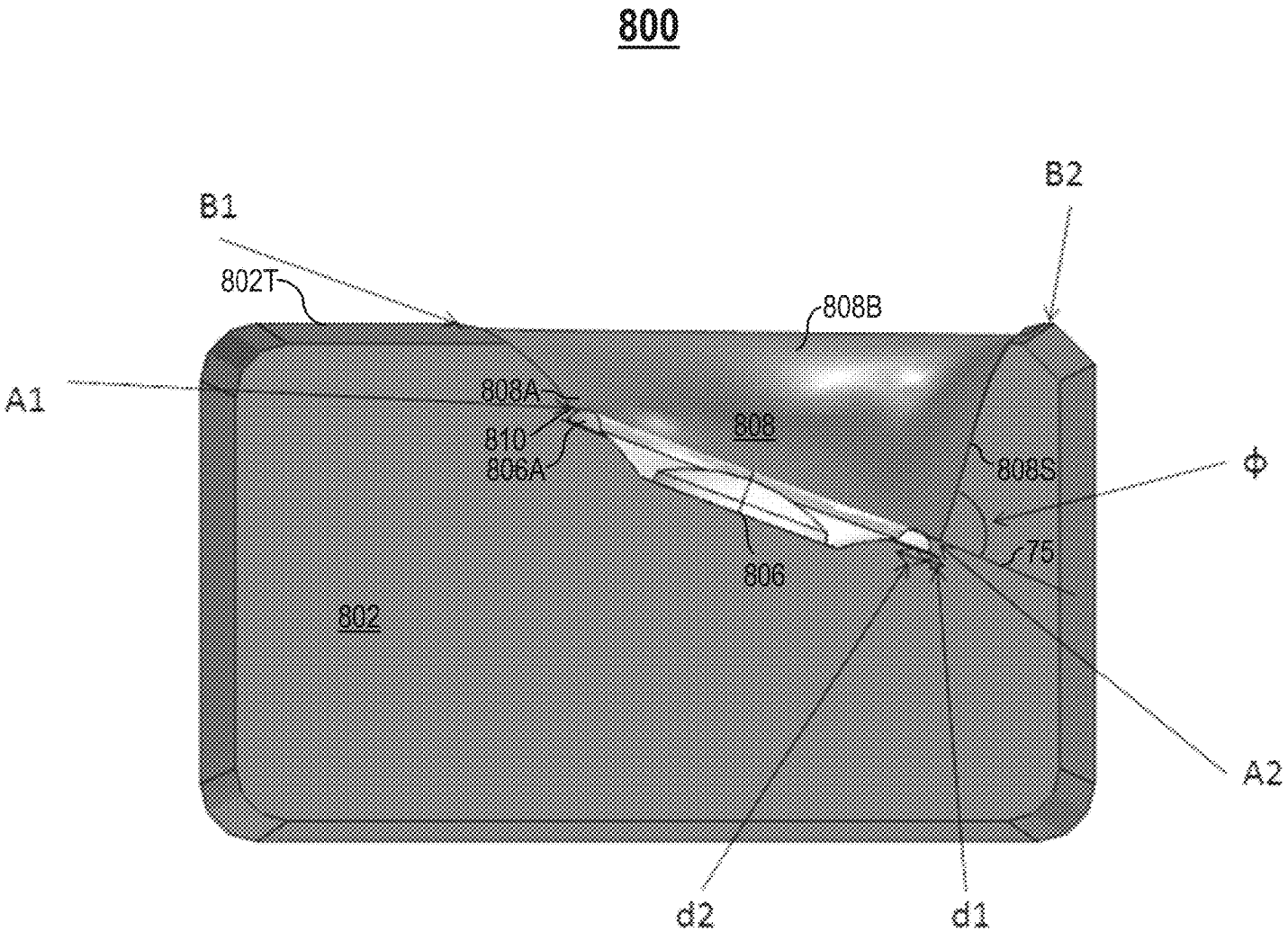
FIG. 10B illustrates a cross-section of a side view of the speaker device in FIG. 10A, in accordance with one embodiment.

FIG. 10A illustrates a top, front perspective view of an example speaker device 800 comprising a height channel speaker 803 having a horn-shaped waveguide 808 that smoothly transitions to a quadrilateral exit 804, in accordance with one embodiment. FIG. 10B illustrates a cross-section of a side view of the speaker device 800, in accordance with one embodiment. The speaker device 800 comprises a speaker housing 802 including one or more sound sources. Specifically, a top plane (i.e., a top surface) 802T of the speaker housing 802 comprises a height channel speaker 803. The top plane 802T is substantially parallel to the horizontal axis 20. The height channel speaker 803 comprises an upward-facing speaker driver 806 disposed within a recessed area 802R of the top plane 802T. In one embodiment, the driver 806 lies flush inside the recessed area 802R.

The driver 806 is positioned/mounted axially in a recessed mounting surface 810 that defines a base of the recessed area 802R. In one embodiment, the driver 806 has a surround suspension element 806A (i.e., an edge) that the mounting surface 810 is shaped to receive and engage with for maintaining the driver 806 within the recessed area 802R. For example, the surround suspension element 806A comprises a surround roll.

One or more recessed sidewalls 808S of the recessed area 802R connecting the mounting surface 810 to the top plane 802T form a horn-shaped waveguide 808. The waveguide 808 has a quadrilateral exit 804 defined as a quadrilateral cutout/opening in the top plane 802T where the recessed sidewalls 808S join/meet the top plane 802T. As shown in FIG. 10A, the quadrilateral exit 804 has a trapezoidal shape. In another embodiment, the quadrilateral exit 804 has another quadrilateral shape, such as a square, a rectangle, etc. In yet another embodiment, the waveguide 808 has a polygonal exit instead (i.e., the exit has a polygonal shape). The waveguide 808 smoothly ends at the quadrilateral exit 804. During operation of the speaker device 800, the waveguide 808 shapes propagation of acoustic energy reproduced by the driver 806 to project the acoustic energy out of the quadrilateral exit 804 in an upwardly inclined direction. A bottom portion 808A of the waveguide 808 begins at an upper point A1 and a lower point A2 along a plane 75 that is parallel to a diaphragm of the driver 806 (e.g., a plane inclined at 20 degrees from the horizontal axis). In one embodiment, an angle φ formed between a recessed sidewall 808S and the plane 75 is about 90 degrees.

As shown in FIG. 10B, a distance d1 between a recessed sidewall 808S and the surround suspension element 806A is substantially smaller than a diameter d2 of the surround suspension element 806A, thereby providing the waveguide 808 with a narrow base that is close to the driver 806. In one embodiment, d1 is about 0 mm. In one embodiment, d1 is about 1 mm to account for manufacturing/positioning tolerance. A top portion 808B of the waveguide 808 smoothly ends at the quadrilateral exit 804 at points B1 and B2 in the top plane 802T. The recessed sidewalls 808S end substantially tangential to the top plane 802T. The recessed sidewalls 808S transition smoothly and continually between the points A1 and A2 along the plane 75 and the points B1 and B2 in the top plane 802T.

Figure 10C:
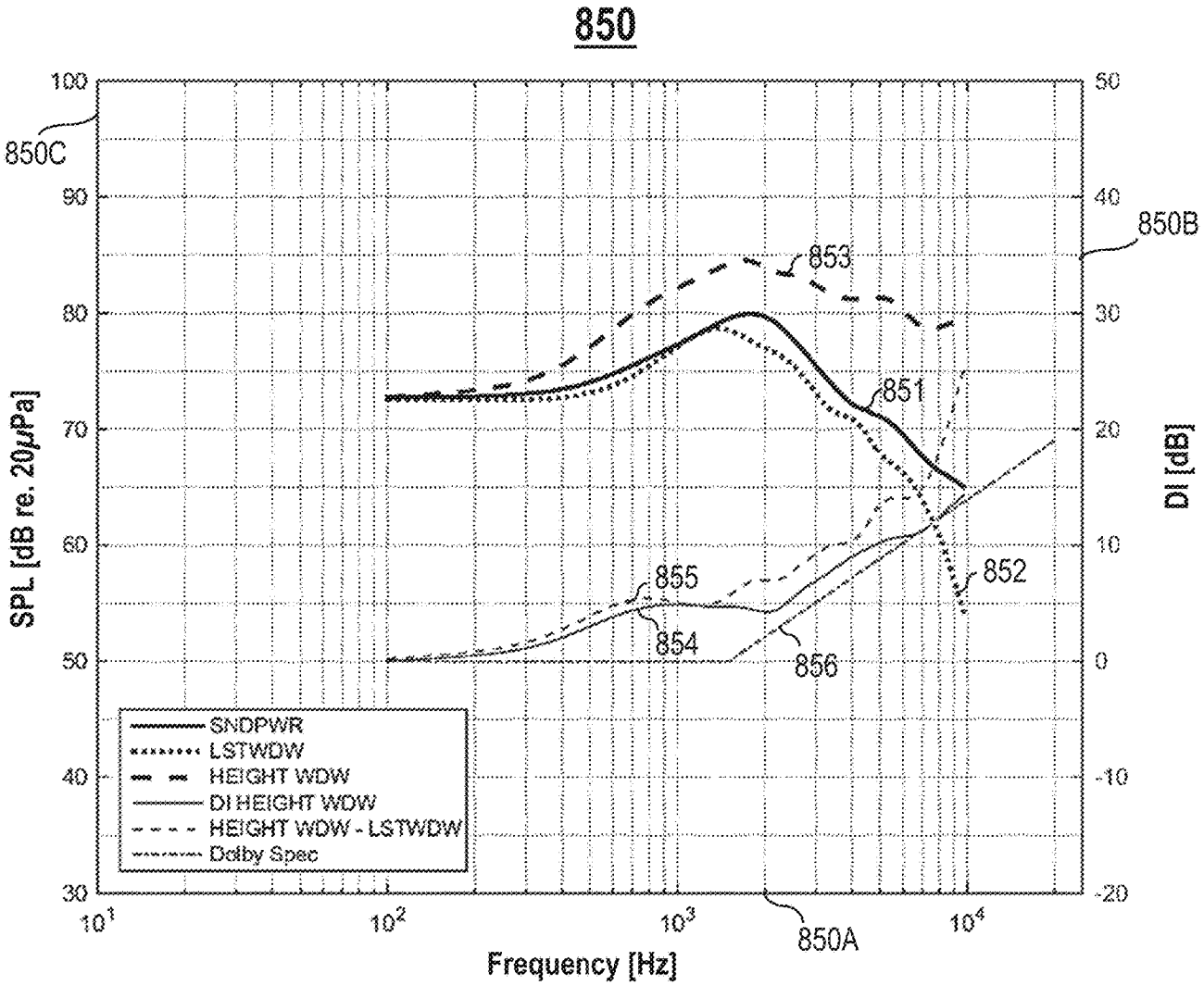
FIG. 10C is an example graph illustrating sound power levels of audio reproduced by the speaker device in FIG. 10A over a frequency domain, in accordance with one embodiment.

FIG. 10C is an example graph 850 illustrating sound power levels of audio reproduced by the speaker device 800 over a frequency domain, in accordance with one embodiment. The graph 850 comprises a sound power curve 851, a listening window curve 852, a height window curve 853, a height DI curve 854, a difference curve 855, and a spec curve 856. A horizontal axis 850A represents frequency values of the frequency domain expressed in Hz units. A left vertical axis 850C represents sound power levels of the curves 851-853 expressed in dB units. A right vertical axis 850B represents sound power levels of the curves 854-856 expressed in dB units.

As shown in FIG. 10C, the height DI curve 854 exhibits a dip at about 2 kHz frequency. Compared to the height DI curve 754 for the speaker device 700, the height DI curve 854 is smoother.

Figure 11B:
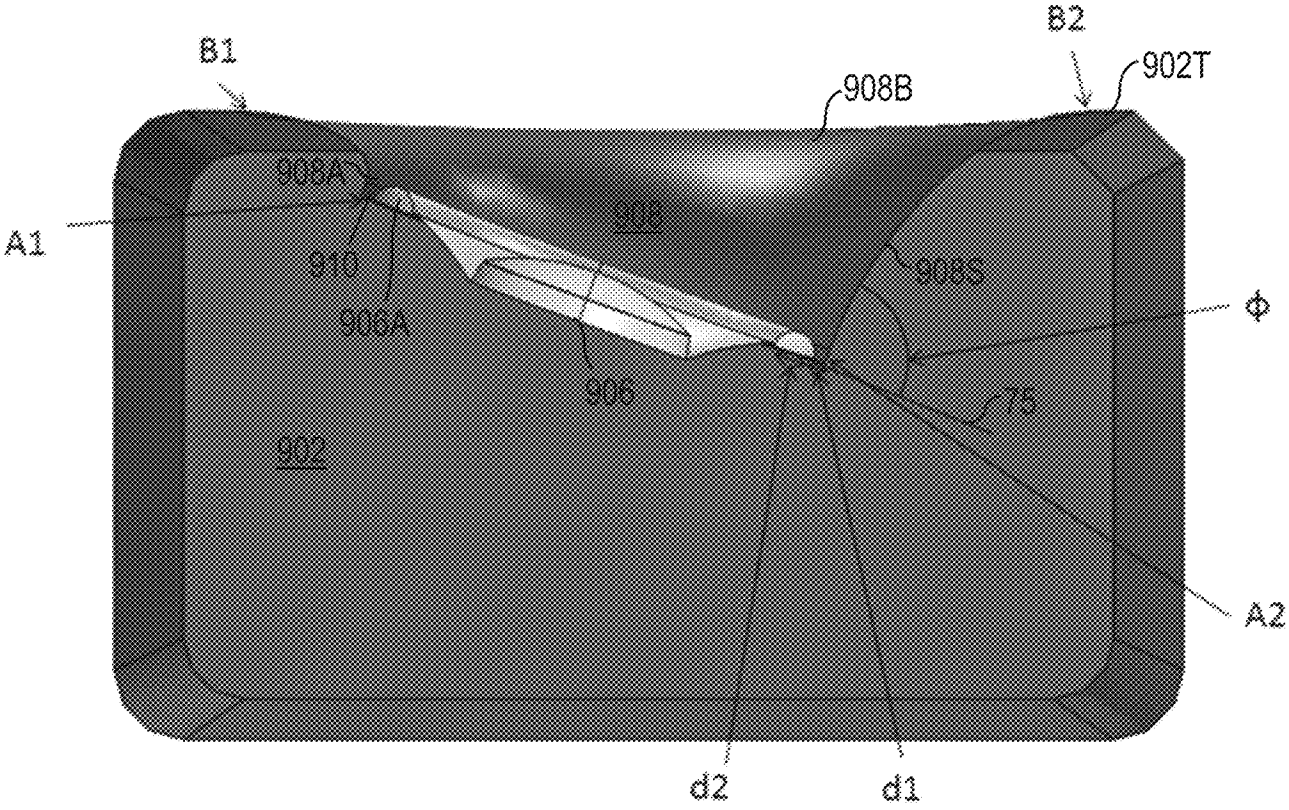
FIG. 11B illustrates a cross-section of a side view of the speaker device in FIG. 11A, in accordance with one embodiment.

FIG. 11A illustrates a top, front perspective view of an example speaker device 900 comprising a height channel speaker 903 having a horn-shaped waveguide 908 that smoothly transitions to an elliptical exit 904, in accordance with one embodiment. FIG. 11B illustrates a cross-section of a side view of the speaker device 900, in accordance with one embodiment. The speaker device 900 comprises a speaker housing 902 including one or more sound sources. Specifically, a top plane (i.e., a top surface) 902T of the speaker housing 902 comprises a height channel speaker 903. The top plane 902T is substantially parallel to a horizontal axis 20. The height channel speaker 903 comprises an upward-facing speaker driver 906 disposed within a recessed area 902R of the top plane 902T. In one embodiment, the driver 906 lies flush inside the recessed area 902R.

The driver 906 is positioned/mounted axially in a recessed mounting surface 910 that defines a base of the recessed area 902R. In one embodiment, the driver 906 has a surround suspension element 906A (e.g., a surround roll) that the mounting surface 910 is shaped to receive and engage with for maintaining the driver 906 within the recessed area 902R.

One or more recessed sidewalls 908S of the recessed area 902R connecting the mounting surface 910 to the top plane 902T form a horn-shaped waveguide 908. The waveguide 908 has an elliptical exit 904 defined as an elliptical cutout/opening in the top plane 902T where the recessed sidewalls 908S join/meet the top plane 902T. The waveguide 908 smoothly ends at the elliptical exit 904. During operation of the speaker device 900, the waveguide 908 shapes propagation of acoustic energy reproduced by the driver 906 to project the acoustic energy out of the elliptical exit 904 in an upwardly inclined direction. A bottom portion 908A of the waveguide 908 begins at an upper point A1 and a lower point A2 along a plane 75 that is parallel to a diaphragm of the driver 906 (e.g., a plane inclined at 20 degrees from the horizontal axis). In one embodiment, an angle φ formed between a recessed sidewall 908S and the plane 75 is about 90 degrees.

As shown in FIG. 11B, a distance d1 between a recessed sidewall 908S and the surround suspension element 906A is substantially smaller than a diameter d2 of the surround suspension element 906A, thereby providing the waveguide 908 with a narrow base that is close to the driver 906. A top portion 908B of the waveguide 908 smoothly ends at the elliptical exit 904 at points B1 and B2 in the top plane 902T. The recessed sidewalls 908S end substantially tangential to the top plane 902T. The recessed sidewalls 908S transition smoothly and continually between the points A1 and A2 along the plane 75 and the points B1 and B2 in the top plane 902T.

Figure 11C:
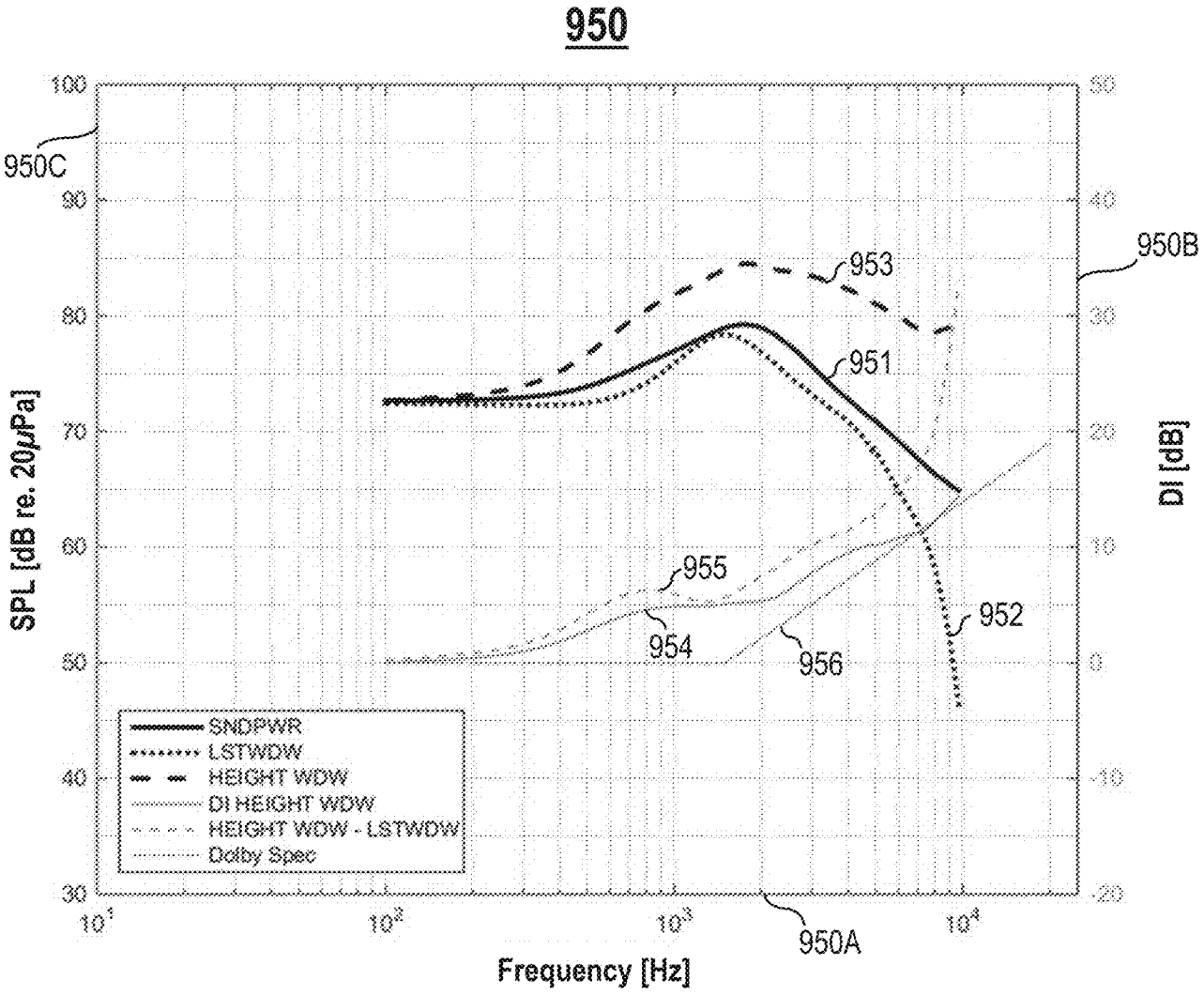
FIG. 11C is an example graph illustrating sound power levels of audio reproduced by the speaker device in FIG. 11A over a frequency domain, in accordance with one embodiment.

FIG. 11C is an example graph 950 illustrating sound power levels of audio reproduced by the speaker device 900 over a frequency domain, in accordance with one embodiment. The graph 950 comprises a sound power curve 951, a listening window curve 952, a height window curve 953, a height DI curve 954, a difference curve 955, and a spec curve 956. A horizontal axis 950A represents frequency values of the frequency domain expressed in Hz units. A left vertical axis 950C represents sound power levels of the curves 951-953 expressed in dB units. A right vertical axis 950B represents sound power levels of the curves 954-956 expressed in dB units.

Compared to the height DI curve 754 for the speaker device 700, the height DI curve 954 is smoother.

Figure 12A:
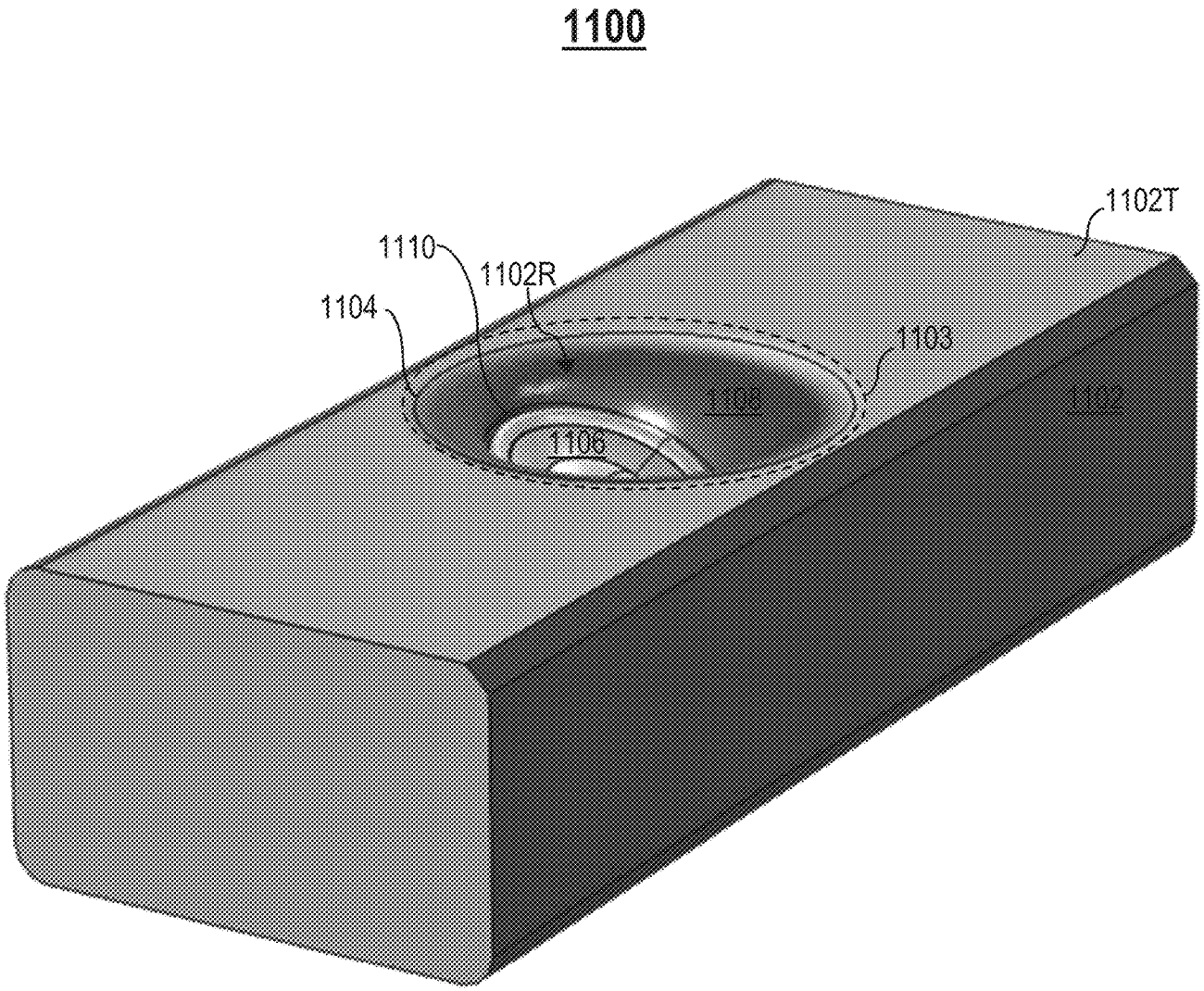
FIG. 12A illustrates a top, front perspective view of an example speaker device comprising a height channel speaker having a horn-shaped waveguide that smoothly transitions to a circular exit, in accordance with one embodiment.
Figure 12B:
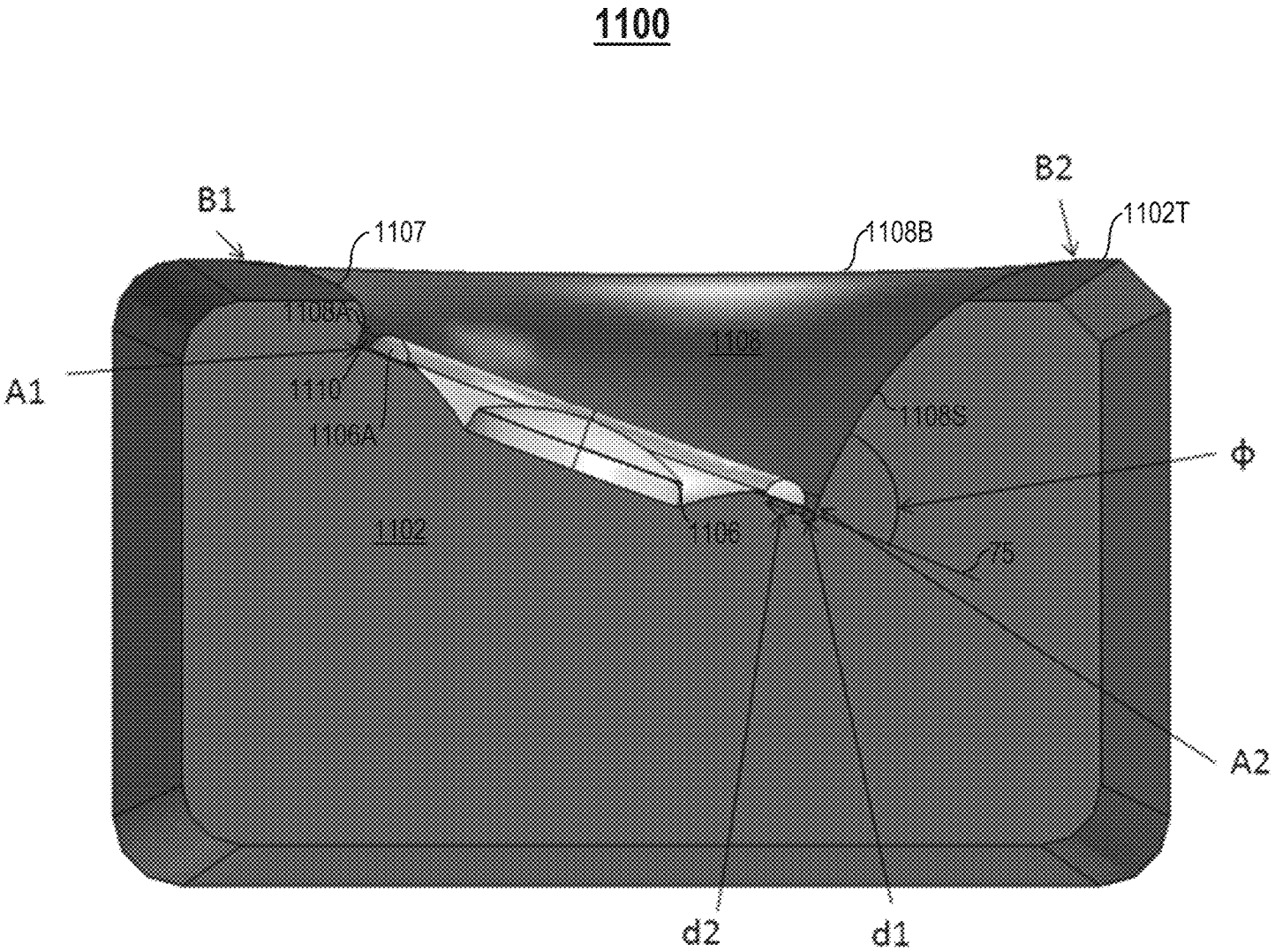
FIG. 12B illustrates a cross-section of a side view of the speaker device in FIG. 12A, in accordance with one embodiment.

FIG. 12A illustrates a top, front perspective view of an example speaker device 1100 comprising a height channel speaker 1103 having a horn-shaped waveguide 1108 that smoothly transitions to a circular exit 1104, in accordance with one embodiment. FIG. 12B illustrates a cross-section of a side view of the speaker device 1100, in accordance with one embodiment. The speaker device 1100 comprises a speaker housing 1102 including one or more sound sources. Specifically, a top plane (i.e., a top surface) 1102T of the speaker housing 1102 comprises a height channel speaker 1103. The top plane 1102T is substantially parallel to a horizontal axis 20. The height channel speaker 1103 comprises an upward-facing speaker driver 1106 disposed within a recessed area 1102R of the top plane 1102T. In one embodiment, the driver 1106 lies flush inside the recessed area 1102R.

The driver 1106 is positioned/mounted axially in a recessed mounting surface 910 that defines a base of the recessed area 1102R. In one embodiment, the driver 1106 has a surround suspension element 1106A (e.g., a surround roll) that the mounting surface 910 is shaped to receive and engage with for maintaining the driver 1106 within the recessed area 1102R.

One or more recessed sidewalls 1108S of the recessed area 1102R connecting the mounting surface 910 to the top plane 1102T form a horn-shaped waveguide 1108. The waveguide 1108 has a circular exit 1104 defined as a circular cutout/opening in the top plane 1102T where the recessed sidewalls 1108S join/meet the top plane 1102T. The waveguide 1108 smoothly ends at the circular exit 1104. During operation of the speaker device 1100, the waveguide 1108 shapes propagation of acoustic energy reproduced by the driver 1106 to project the acoustic energy out of the circular exit 1104 in an upwardly inclined direction. A bottom portion 1108A of the waveguide 1108 begins at an upper point A1 and a lower point A2 along a plane 75 that is parallel to a diaphragm of the driver 1106 (e.g., a plane inclined at 20 degrees from the horizontal axis). In one embodiment, an angle φ formed between a recessed sidewall and the plane 75 is about 90 degrees.

As shown in FIG. 12B, a distance d1 between a recessed sidewall and the surround suspension element 1106A is substantially smaller than a diameter d2 of the surround suspension element 1106A, thereby providing the waveguide 1108 with a narrow base that is close to the driver 1106. A top portion 1108B of the waveguide 1108 smoothly ends at the circular exit 1104 at points B1 and B2 in the top plane 1102T. The recessed sidewalls 1108S end substantially tangential to the top plane 1102T. The recessed sidewalls 1108S transition smoothly and continually between the points A1 and A2 along the plane 75 and the points B1 and B2 in the top plane 1102T. A transition region 1007 is formed between the recessed sidewalls 1108S and the top plane 1102T.

In one embodiment, x1 is about 10 mm, and x2 is about 30 mm (i.e., x1 is about 33% of x2).

Figure 12C:
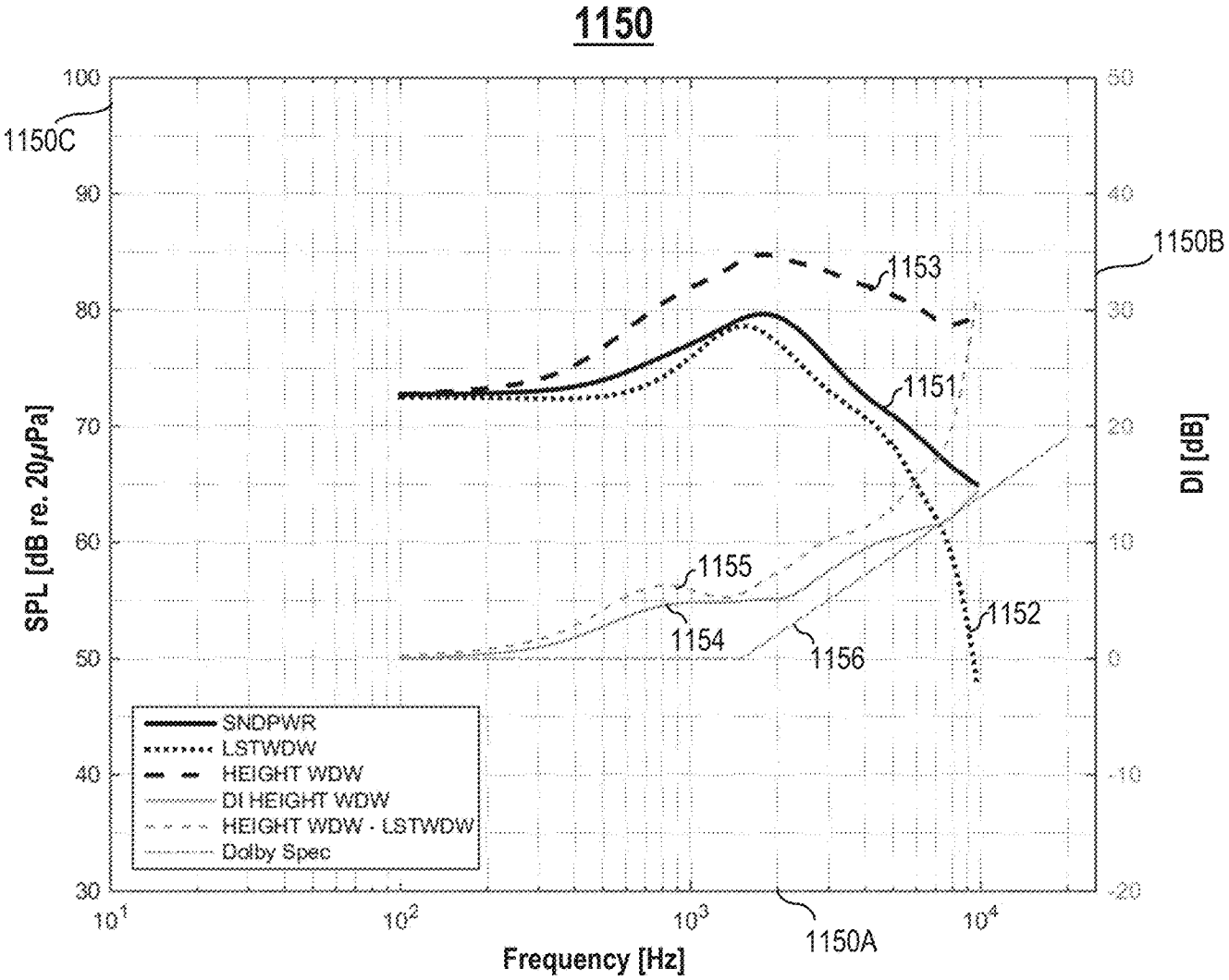
FIG. 12C is an example graph illustrating sound power levels of audio reproduced by the speaker device in FIG. 12A over a frequency domain, in accordance with one embodiment.

FIG. 12C is an example graph 1150 illustrating sound power levels of audio reproduced by the speaker device 1100 over a frequency domain, in accordance with one embodiment. The graph 1150 comprises a sound power curve 1151, a listening window curve 1152, a height window curve 1153, a height DI curve 1154, a difference curve 1155, and a spec curve 1156. A horizontal axis 1150A represents frequency values of the frequency domain expressed in Hz units. A left vertical axis 1150C represents sound power levels of the curves 1151-1153 expressed in dB units. A right vertical axis 1150B represents sound power levels of the curves 1154-1156 expressed in dB units.

As shown in FIG. 12C, the height DI curve 1154 does not exhibit any dips, indicating that the speaker device 1100 provides good sound quality.

Figure 13A:
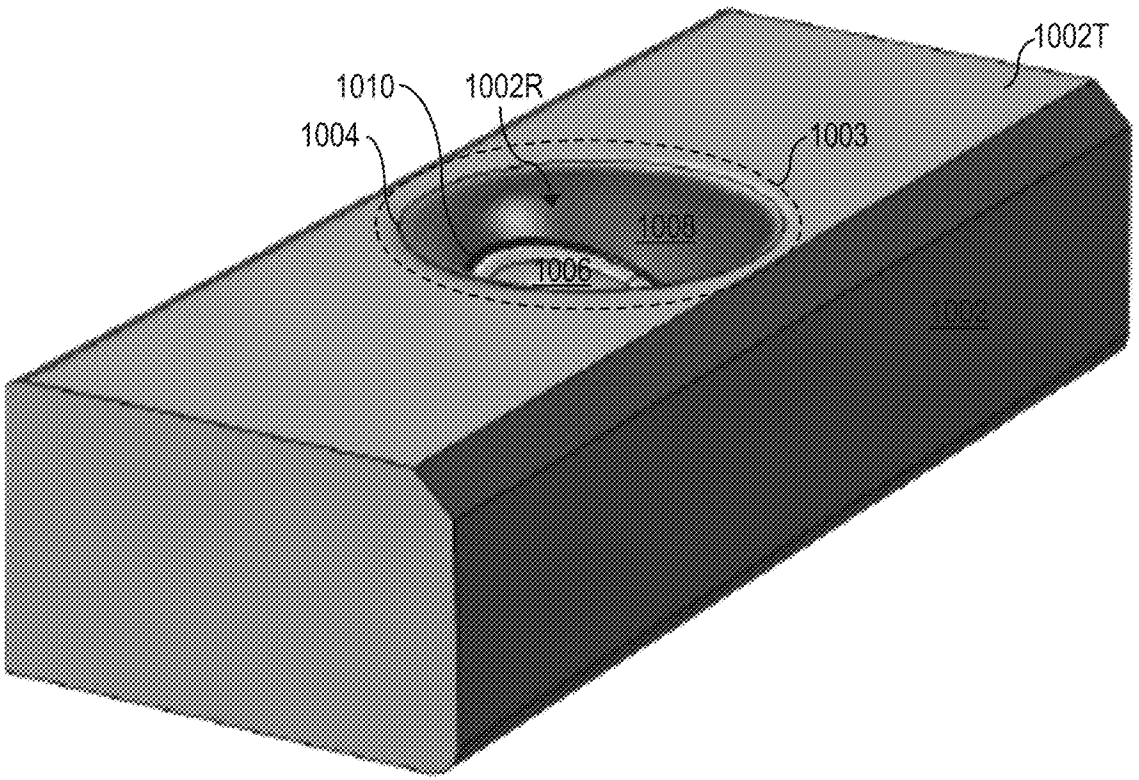
FIG. 13A illustrates a top, front perspective view of an example speaker device comprising a height channel speaker having a deeply set driver and a horn-shaped waveguide that smoothly transitions to a circular exit, in accordance with one embodiment.
Figure 13B:
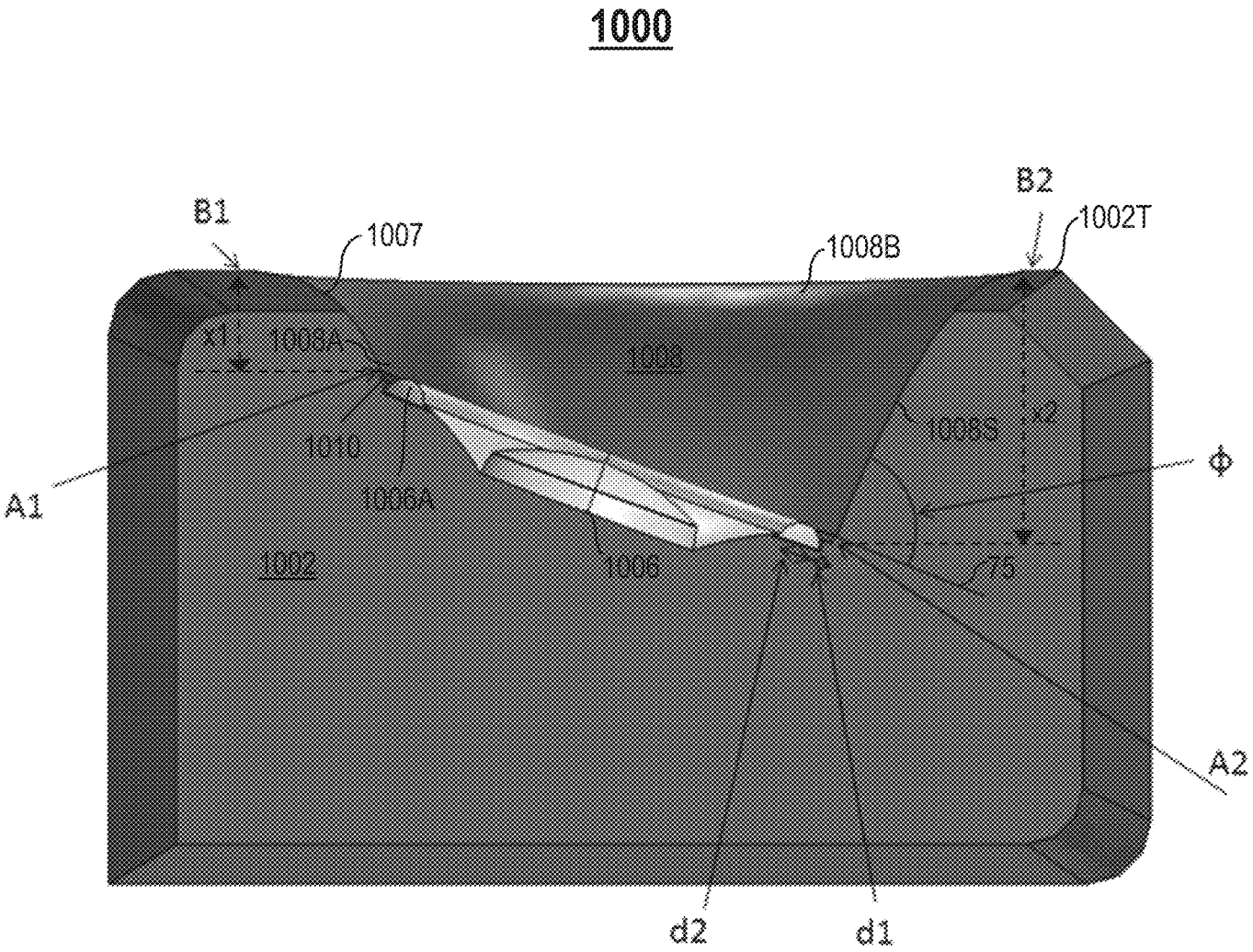
FIG. 13B illustrates a cross-section of a side view of the speaker device in FIG. 13A, in accordance with one embodiment.

FIG. 13A illustrates a top, front perspective view of an example speaker device 1000 comprising a height channel speaker 1003 having a deeply set driver 1006 and a horn-shaped waveguide 1008 that smoothly transitions to a circular exit 1004, in accordance with one embodiment. FIG. 13B illustrates a cross-section of a side view of the speaker device 1000, in accordance with one embodiment. The speaker device 1000 comprises a speaker housing 1002 including one or more sound sources. Specifically, a top plane (i.e., a top surface) 1002T of the speaker housing 1002 comprises a height channel speaker 1003. The top plane 1002T is substantially parallel to a horizontal axis 20. The height channel speaker 1003 comprises an upward-facing speaker driver 1006 disposed within a recessed area 1002R of the top plane 1002T. In one embodiment, the driver 1006 lies flush inside the recessed area 1002R.

The driver 1006 is positioned/mounted axially in a recessed mounting surface 1010 that defines a base of the recessed area 1002R. In one embodiment, the driver 1006 has a surround suspension element 1006A (e.g., a surround roll) that the mounting surface 1010 is shaped to receive and engage with for maintaining the driver 1006 within the recessed area 1002R.

One or more recessed sidewalls 1008S of the recessed area 1002R connecting the mounting surface 1010 to the top plane 1002T form a horn-shaped waveguide 1008. In one embodiment, the waveguide 1008 has a circular exit 1004 defined as a circular cutout/opening in the top plane 1002T where the recessed sidewalls 1008S join/meet the top plane 1002T. In another embodiment, the waveguide 1008 has an exit having another shape, such as an elliptical shape, a quadrilateral shape (e.g., a trapezoid, a square, a rectangle, etc.), a polygonal shape, etc.

A smooth transition region 1007 is formed between the recessed sidewalls 1008S and the top plane 1002T. In one embodiment, the transition region 1007 is formed along a perimeter of the circular exit 1004. In another embodiment, the transition region 1007 is formed along a portion of the perimeter of the circular exit 1004, wherein the portion of the perimeter is on a side of a listener 30 (i.e., facing a front of the speaker device 1000). Compared to the transition region 1107 in FIG. 12B, the transition region 1007 is less curved (i.e., more smooth).

The waveguide 1008 smoothly ends at the circular exit 1004. During operation of the speaker device 1000, the waveguide 1008 shapes propagation of acoustic energy reproduced by the driver 1006 to project the acoustic energy out of the circular exit 1004 in an upwardly inclined direction. A bottom portion 1008A of the waveguide 1008 begins at an upper point A1 and a lower point A2 along a plane 75 that is parallel to a diaphragm of the driver 1006 (e.g., a plane inclined at 20 degrees from the horizontal axis). In one embodiment, an angle φ formed between a recessed sidewall 1008S and the plane 75 is about 100 degrees.

As shown in FIG. 13B, a distance d1 between a recessed sidewall 1008S and the surround suspension element 1006A is substantially smaller than a diameter d2 of the surround suspension element 1006A, thereby providing the waveguide 1008 with a narrow base. A top portion 1008B of the waveguide 1008 smoothly ends at the circular exit 1004 at points B1 and B2 in the top plane 1002T. The recessed sidewalls 1008S end substantially tangential to the top plane 1002T. The recessed sidewalls 1008S transition smoothly and continually between the points A1 and A2 along the plane 75 and the points B1 and B2 in the top plane 1002T.

The driver 1006 is set deeply into the speaker housing 1002 such that an upper portion of the driver 1006 is positioned a substantial distance below an exterior surface 1002T (i.e., an outer surface) of the speaker housing 1002 and the waveguide 1008 has a rear portion. Let x1 denote a distance between the upper point A1 along the plane 75 and the top plane 1002T. Let x2 denote a distance between the lower point A2 along the plane 75 and the top plane 1002T. In one embodiment, the upper point A1 is positioned below the top plane 1002T by a distance x1 that is at least about 40% of a distance x2. In another embodiment, the upper point A1 is positioned below the top plane 1002T by a distance x1 that is at least about 50% of a distance x2. In yet another embodiment, the upper point A1 is positioned below the top plane 1002T by a distance x1 that is at least about 60% of a distance x2.

In one embodiment, x1 is about 20 mm, and x2 is about 40 mm (i.e., x1 is about 50% of x2).

Figure 13C:
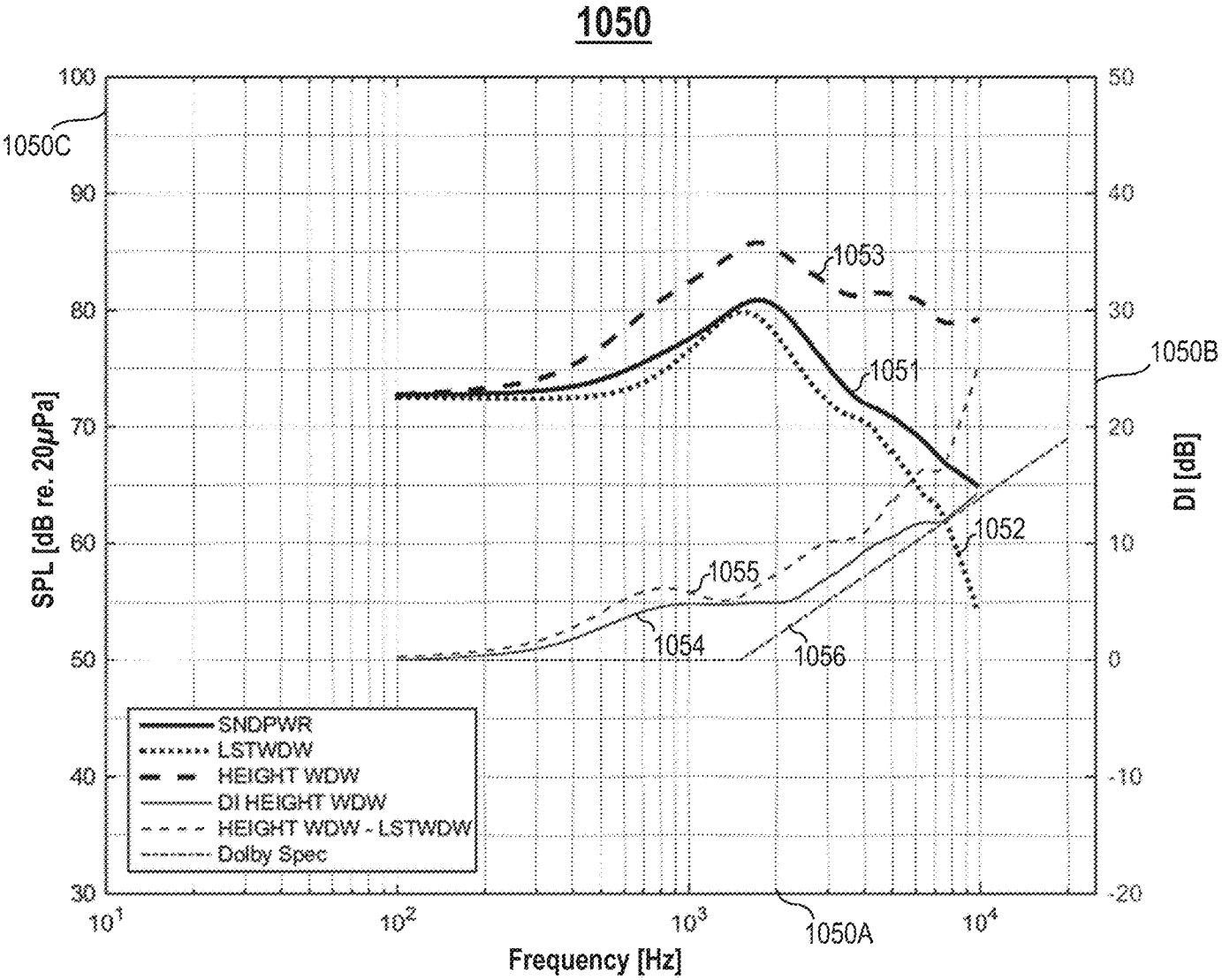
FIG. 13C is an example graph illustrating sound power levels of audio reproduced by the speaker device in FIG. 13A over a frequency domain, in accordance with one embodiment.

FIG. 13C is an example graph 1050 illustrating sound power levels of audio reproduced by the speaker device 1000 over a frequency domain, in accordance with one embodiment. The graph 1050 comprises a sound power curve 1051, a listening window curve 1052, a height window curve 1053, a height DI curve 1054, a difference curve 1055, and a spec curve 1056. A horizontal axis 1050A represents frequency values of the frequency domain expressed in Hz units. A left vertical axis 1050C represents sound power levels of the curves 1051-1053 expressed in dB units. A right vertical axis 1050B represents sound power levels of the curves 1054-1056 expressed in dB units.

As shown in FIG. 13C, the height DI curve 1054 does not exhibit any dips, indicating that the speaker device 1000 provides good sound quality.

Figure 14A:
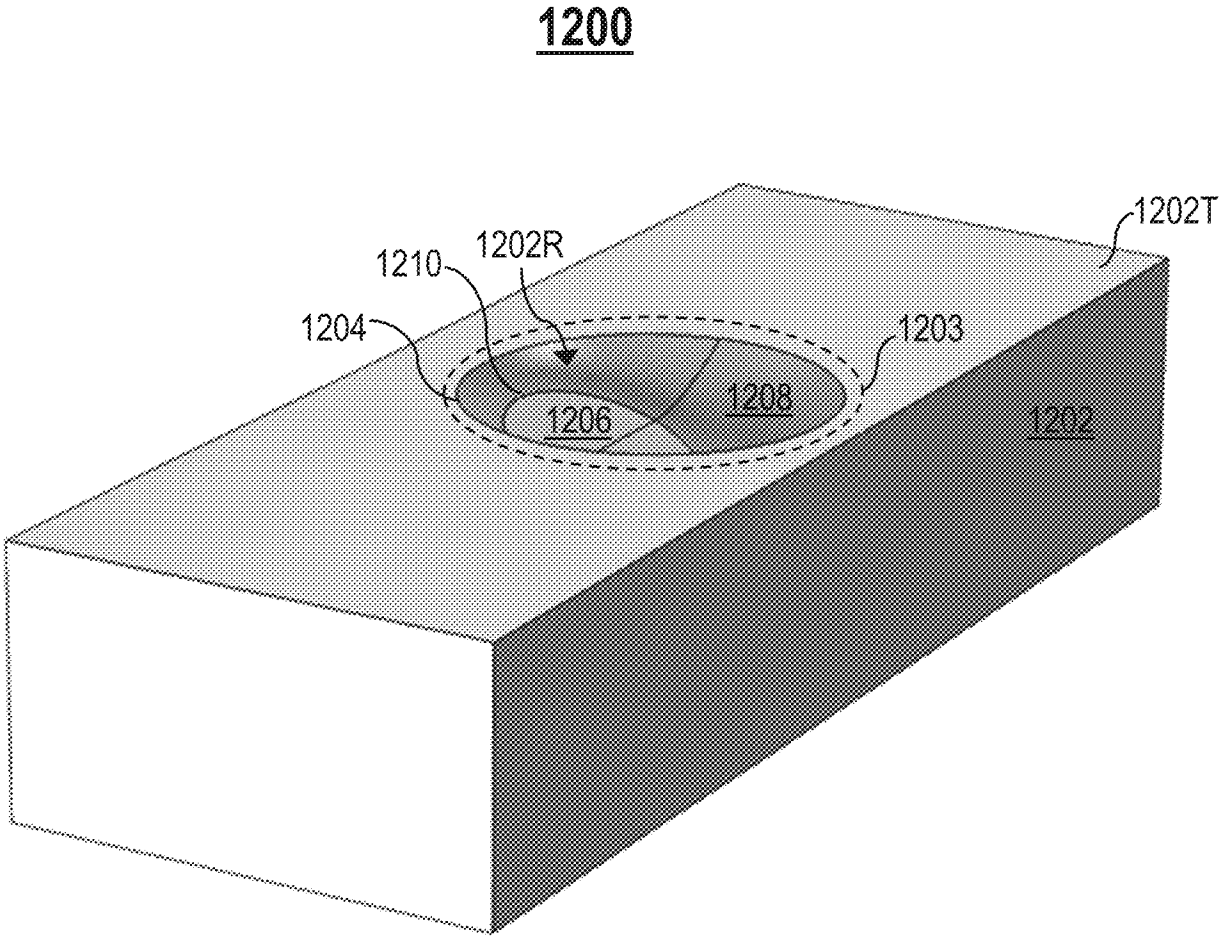
FIG. 14A illustrates a top, front perspective view of an example speaker device comprising a height channel speaker having a cup-shaped waveguide that smoothly transitions to a circular exit, in accordance with one embodiment.

FIG. 14A illustrates a top, front perspective view of an example speaker device 1200 comprising a height channel speaker 1203 having a cup-shaped waveguide 1208 that smoothly transitions to a circular exit 1204, in accordance with one embodiment. The speaker device 1200 comprises a speaker housing 1202 including one or more sound sources. Specifically, a top plane (i.e., a top surface) 1202T of the speaker housing 1202 comprises a height channel speaker 1203. The top plane 1202T is substantially parallel to the horizontal axis 20. The height channel speaker 1203 comprises an upward-facing speaker driver 1206 disposed within a recessed area 1202R of the top plane 1202T. In one embodiment, the driver 1206 lies flush inside the recessed area 1202R.

The driver 1206 is positioned/mounted axially in a recessed mounting surface 1210 that defines a base of the recessed area 1202R.

One or more recessed sidewalls of the recessed area 1202R connecting the mounting surface 1210 to the top plane 1202T form a cup-shaped waveguide 1208. The waveguide 1208 has a circular exit 1204 defined as a circular cutout/opening in the top plane 1202T where the recessed sidewalls join/meet the top plane 1202T. During operation of the speaker device 1200, the waveguide 1208 shapes propagation of acoustic energy reproduced by the driver 1206 to project the acoustic energy out of the circular exit 1204 in an upwardly inclined direction.

Figure 14B:
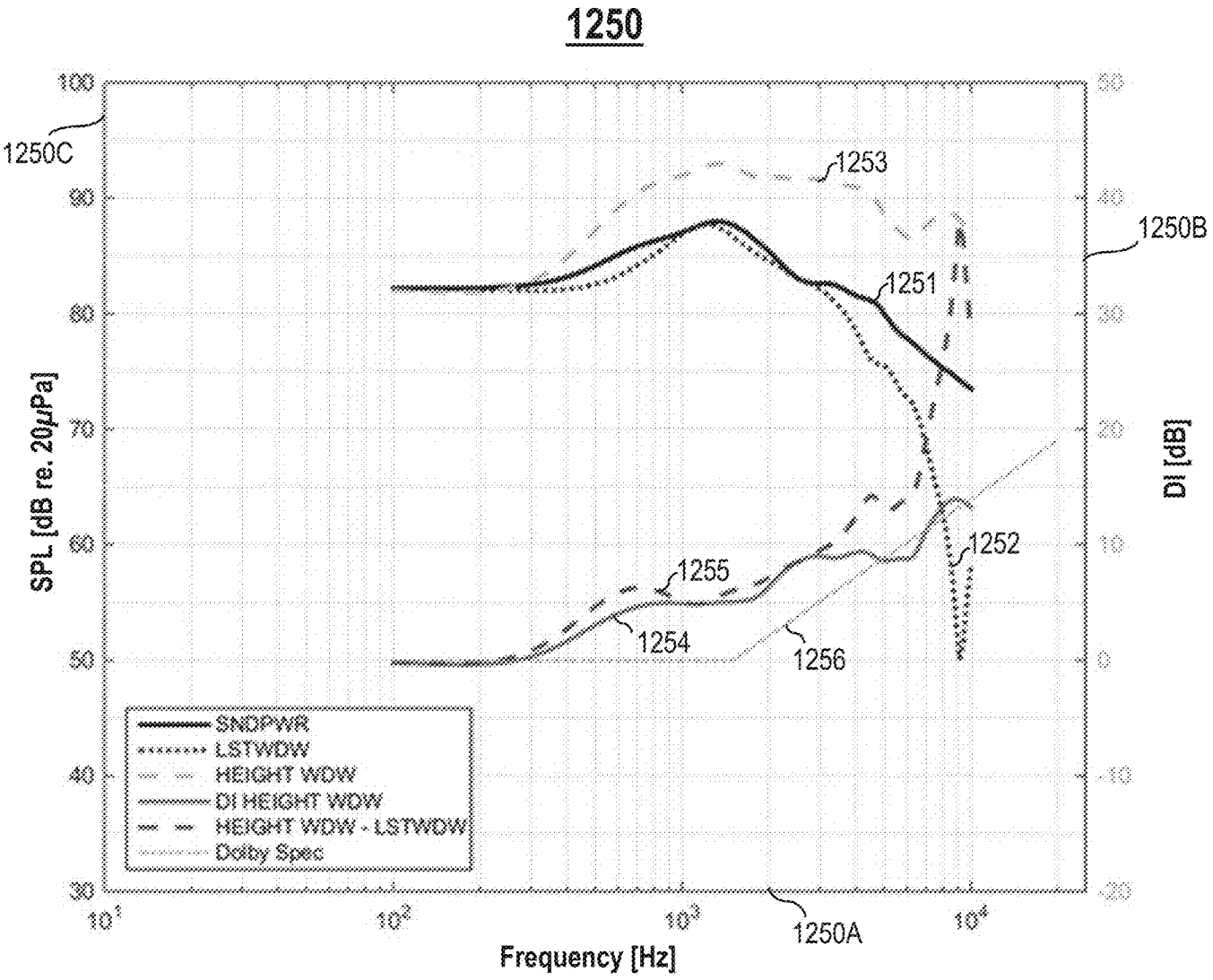
FIG. 14B is an example graph illustrating sound power levels of audio reproduced by the speaker device in FIG. 14A over a frequency domain, in accordance with one embodiment.

FIG. 14B is an example graph 1250 illustrating sound power levels of audio reproduced by the speaker device 1200 over a frequency domain, in accordance with one embodiment. The graph 1250 comprises a sound power curve 1251, a listening window curve 1252, a height window curve 1253, a height DI curve 1254, a difference curve 1255, and a spec curve 1256. A horizontal axis 1250A represents frequency values of the frequency domain expressed in Hz units. A left vertical axis 1250C represents sound power levels of the curves 1251-1253 expressed in dB units. A right vertical axis 1250B represents sound power levels of the curves 1254-1256 expressed in dB units.

As shown in FIG. 14B, the height DI curve 1254 exhibits small dips, which may negatively influence perceived sound quality.

Figure 15A:
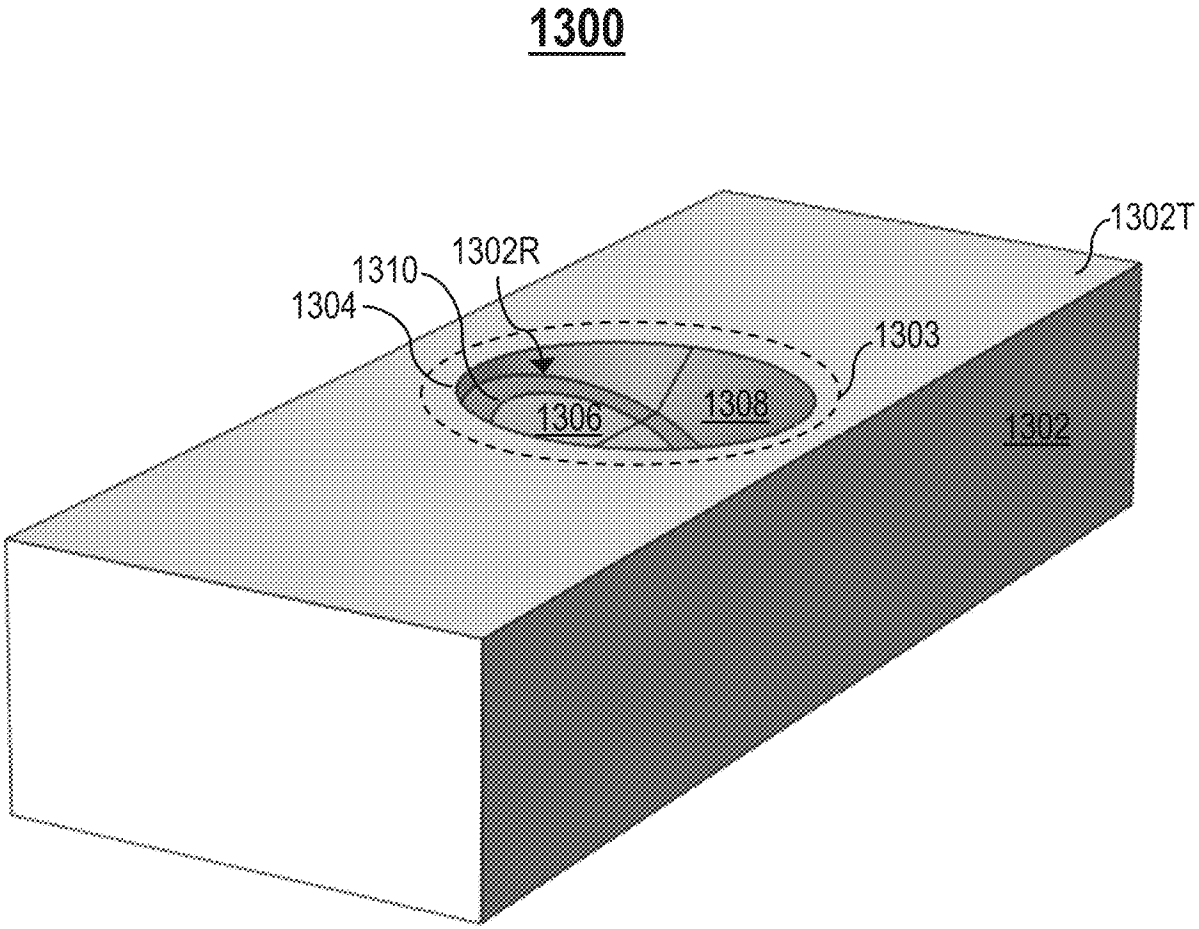
FIG. 15A illustrates a top, front perspective view of an example speaker device comprising a height channel speaker having a cone-shaped waveguide that smoothly transitions to a circular exit, in accordance with one embodiment.

FIG. 15A illustrates a top, front perspective view of an example speaker device 1300 comprising a height channel speaker 1303 having a cone-shaped waveguide 1308 that smoothly transitions to a circular exit 1304, in accordance with one embodiment. The speaker device 1300 comprises a speaker housing 1302 including one or more sound sources. Specifically, a top plane (i.e., a top surface) 1302T of the speaker housing 1302 comprises a height channel speaker 1303. The top plane 1302T is substantially parallel to the horizontal axis 20. The height channel speaker 1303 comprises an upward-facing speaker driver 1306 disposed within a recessed area 1302R of the top plane 1302T. In one embodiment, the driver 1306 lies flush inside the recessed area 1302R.

The driver 1306 is positioned/mounted axially in a recessed mounting surface 1310 that defines a base of the recessed area 1302R.

One or more recessed sidewalls of the recessed area 1302R connecting the mounting surface 1310 to the top plane 1302T form a cone-shaped waveguide 1308. The waveguide 1308 has a circular exit 1304 defined as a circular cutout/opening in the top plane 1302T where the recessed sidewalls join/meet the top plane 1302T. During operation of the speaker device 1300, the waveguide 1308 shapes propagation of acoustic energy reproduced by the driver 1306 to project the acoustic energy out of the circular exit 1304 in an upwardly inclined direction.

Figure 15B:
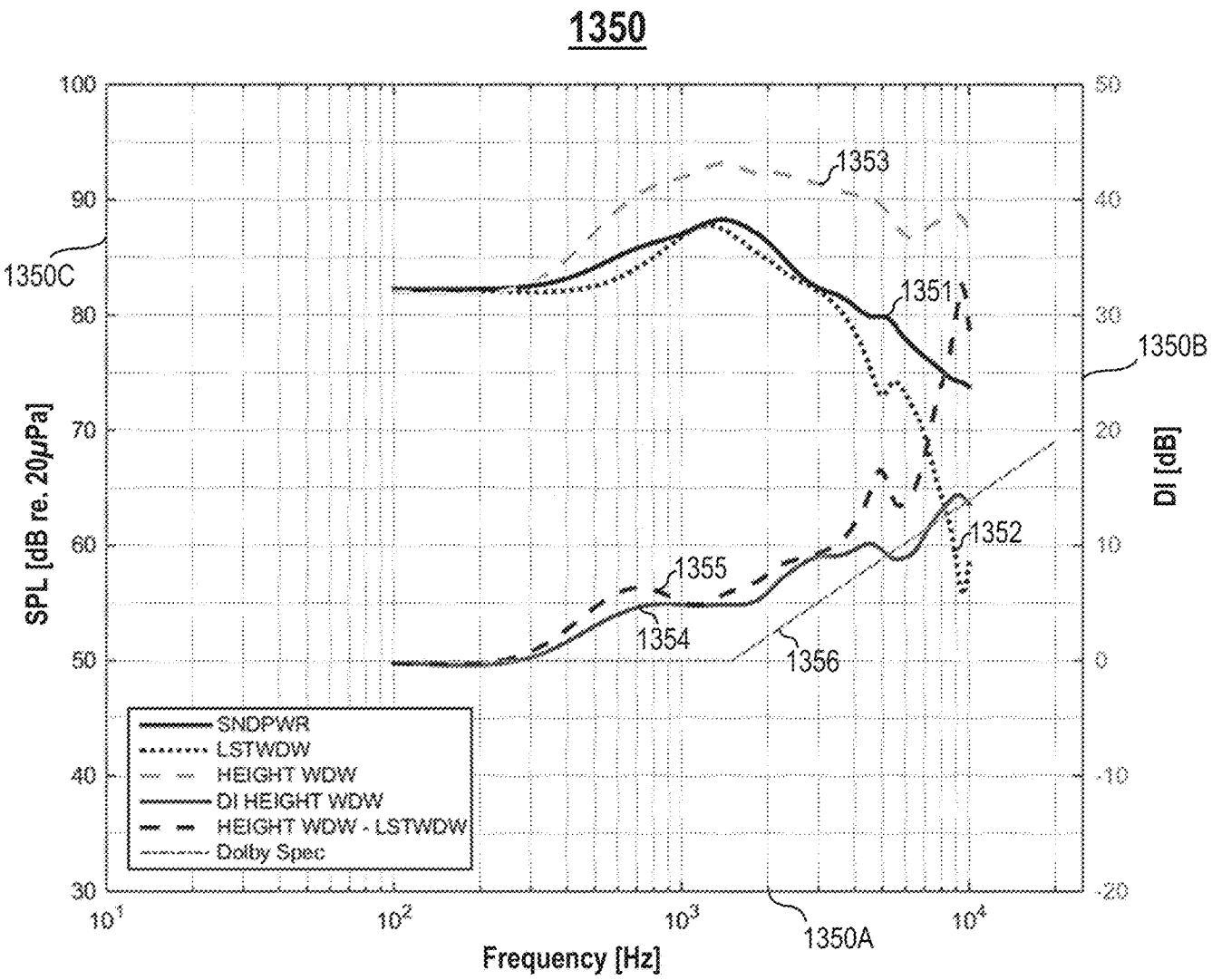
FIG. 15B is an example graph illustrating sound power levels of audio reproduced by the speaker device in FIG. 15A over a frequency domain, in accordance with one embodiment.

FIG. 15B is an example graph 1350 illustrating sound power levels of audio reproduced by the speaker device 1300 over a frequency domain, in accordance with one embodiment. The graph 1350 comprises a sound power curve 1351, a listening window curve 1352, a height window curve 1353, a height DI curve 1354, a difference curve 1355, and a spec curve 1356. A horizontal axis 1350A represents frequency values of the frequency domain expressed in Hz units. A left vertical axis 1350C represents sound power levels of the curves 1351-1353 expressed in dB units. A right vertical axis 1350B represents sound power levels of the curves 1354-1356 expressed in dB units.

As shown in FIG. 15B, the height DI curve 1354 exhibits small dips, which may negatively influence perceived sound quality.

Figure 16:
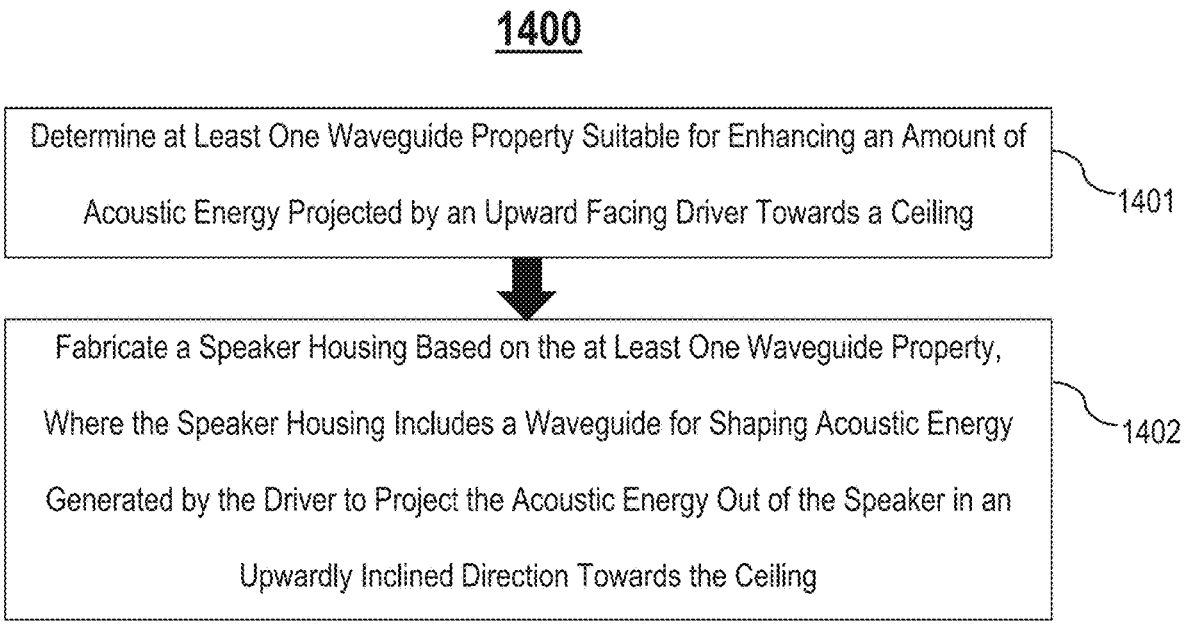
FIG. 16 is an example flowchart for producing a waveguide for a speaker device, in accordance with one embodiment.

FIG. 16 is an example flowchart 1400 for producing a waveguide for a speaker device, in accordance with one embodiment. In process block 1401, determine at least one waveguide property suitable for enhancing an amount of acoustic energy projected by an upward-facing driver of the speaker device towards a ceiling. In process block 1402, fabricate a housing of the speaker device based on the at least one waveguide property, wherein the housing includes a waveguide for shaping propagation of the acoustic energy generated by the driver to project the acoustic energy out of the speaker device in an upwardly inclined direction towards the ceiling.

In one example implementation, the acoustic energy may be projected out of the speaker device in the upwardly inclined direction at an angle that is substantially seventy degrees relative to a horizontal plane to reflect the acoustic energy off the ceiling.

In one example implementation, the waveguide may be defined by an opening included in a top surface of a housing of the speaker device, a recessed mounting surface of the housing spaced vertically downwards from the top surface, and a recessed sidewall extending upwardly from the recessed mounting surface to the opening. The driver is mounted into the recessed mounting surface.

In one example implementation, determining at least one waveguide property may comprise determining a shape of the opening, determining a shape of the recessed sidewall, determining one or more dimensions of the recessed mounting surface, and determining a depth of the waveguide.

In one example implementation, the waveguide has a substantially straight shape defined by one or more straight walls of the recessed sidewall. In another example implementation, the waveguide has a substantially curved shape defined by one or more curved segments of the recessed sidewall.

In one example implementation, an end of the recessed sidewall is substantially tangential to the top surface.

In one example implementation, the shape of the opening is one of substantially circular, substantially elliptical, or substantially quadrilateral.

Figure 17:
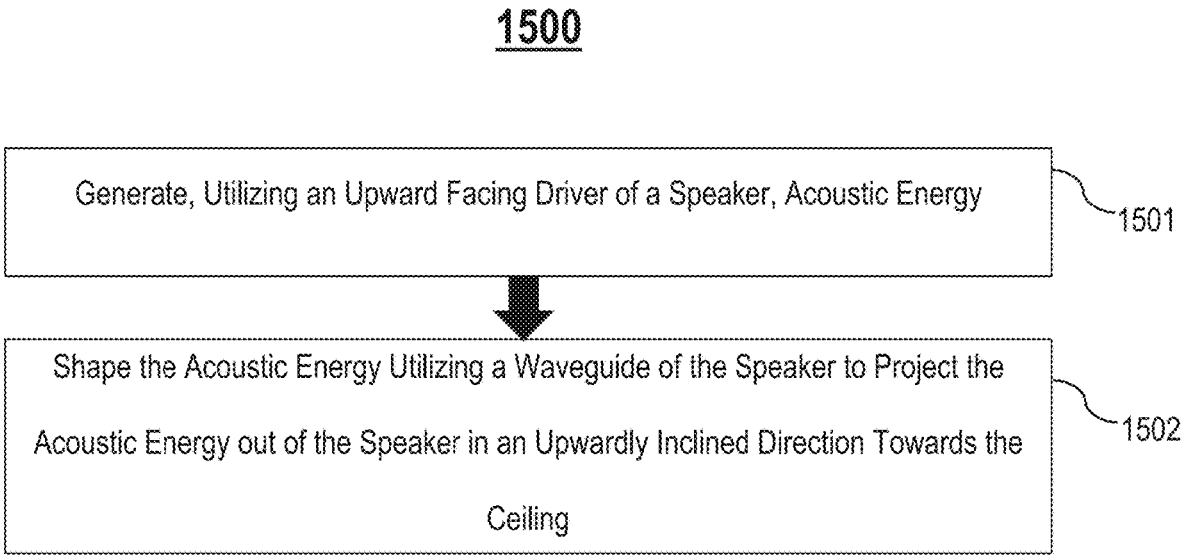
FIG. 17 is an example flowchart for enhancing an amount of acoustic energy projected by an upward-facing driver of a speaker device towards a ceiling, in accordance with one embodiment.

FIG. 17 is an example flowchart 1500 for enhancing an amount of acoustic energy projected by an upward-facing driver of a speaker device towards a ceiling, in accordance with one embodiment. In process block 1501, generate, utilizing the driver, the acoustic energy. In process block 1502, shape propagation of the acoustic energy utilizing a waveguide of the speaker device to project the acoustic energy out of the speaker device in an upwardly inclined direction towards the ceiling.

In one example implementation, the acoustic energy may be projected out of the speaker device in the upwardly inclined direction at an angle that is substantially seventy degrees relative to a horizontal plane to reflect the acoustic energy off the ceiling.

In one example implementation, the waveguide may be defined by an opening included in a top surface of a housing of the speaker device, a recessed mounting surface of the housing spaced vertically downwards from the top surface, and a recessed sidewall extending upwardly from the recessed mounting surface to the opening. The driver is mounted into the recessed mounting surface.

FIG. 18A illustrates a top view of an example height channel speaker 153 in a speaker device 150, in accordance with one embodiment. FIG. 18B illustrates a cross-section of a side view of the height channel speaker 103 in the speaker device 100, in accordance with one embodiment. The speaker device 150 comprises a speaker housing 152 including one or more sound sources (e.g., a speaker driver, etc.). Specifically, a top plane (i.e., a top surface) 152T of the speaker housing 152 comprises a height channel speaker 153. The height channel speaker 153 comprises multiple upward-facing speaker drivers disposed within a recessed area 152R of the top plane 152T. For example, as shown in FIGS. 18A-18B, the height channel speaker 153 comprises a first driver 156A and a second driver 156B. In one embodiment, each driver 156A, 156B lies flush inside the recessed area 152R.

In one embodiment, the drivers 156A and 156B are partially distinct in that both drivers 156A and 156B may have the same general shape, but different sizes (or vice versa). As shown in FIGS. 18A-18B, in one example implementation, the drivers 156A and 156B have the same general shape, but different physical dimensions (e.g., the driver 156A is smaller than the driver 156B). In another example implementation, the drivers 156A and 156B have substantially similar physical dimensions, but different shapes.

Each driver 156A, 156B is positioned/mounted axially in a recessed mounting surface 160 that defines a base of the recessed area 152R. The drivers 156A and 156B are spaced apart in the mounting surface 160. For example, as shown in FIGS. 18A-18B, the first driver 156A is positioned in the mounting surface 160 towards a top of the mounting surface 160, whereas the second driver 156B is positioned in the mounting surface 160 towards a bottom of the mounting surface 160. The drivers 156A and 156B may be positioned in the mounting surface 160 in accordance with other spatial arrangements.

One or more recessed sidewalls 158S of the recessed area 152R connecting the mounting surface 160 to the top plane 152T form a waveguide 158. The drivers 156A and 156B are be positioned inside the same waveguide 158. The waveguide 158 has an exit 154 defined as a cutout/opening in the top plane 152T where the recessed sidewalls 158S join/meet the top plane 152T. During operation of the speaker device 150, the waveguide 158 shapes propagation of acoustic energy reproduced by the drivers 156A and 156B to project the acoustic energy out of the exit 154 in an upwardly inclined direction. A shape of the exit 154 may be circular, quadrilateral (e.g., a trapezoid, a square, a rectangle, etc.), elliptical, polygonal, or any other shape. A shape of the waveguide 158 may be straight or substantially curved (e.g., horn-shaped, cone-shaped, cup-shaped, etc.), depending on a shape of each recessed sidewall 158S.

In one embodiment, the top plane 152T is substantially parallel to a horizontal axis 20. In another embodiment, the top plane 152T is slanted or curved. A forward slanted top plane 152T decreases acoustical occlusion as a forward-facing part of the waveguide 158 is shortened. This reduces a ratio of acoustic energy reflected off the ceiling to acoustic energy leaked to a listener, thereby reducing perception of height in sound.

Though the embodiments have been described with reference to certain versions thereof; however, other versions are possible. Therefore, the spirit and scope of the appended claims should not be limited to the description of the preferred versions contained herein.

What is claimed is:

1. A speaker device, comprising:

a first housing including:

a first top surface comprising a first opening;

a first recessed mounting surface spaced below the first opening; and a first waveguide comprising:

a first recessed sidewall extending upwardly and inclinedly from a diaphragm of a first upward-facing driver mounted into the first recessed mounting surface; and a smoothly curved region spaced below the first top surface, spaced above the first recessed mounting surface, and formed between the first recessed sidewall and the first opening, wherein the smoothly curved region transitions to an exit defined by a shape of the first opening; and the first upward-facing driver;

wherein the first waveguide shapes propagation of acoustic energy generated by the first upward-facing driver to project the acoustic energy out of the speaker device in an upwardly inclined direction.

2. The speaker device of claim 1, wherein the acoustic energy generated by the first upward-facing driver is projected out of the speaker device in the upwardly inclined direction at an angle that is substantially seventy degrees relative to a horizontal plane to reflect the acoustic energy off a ceiling.

3. The speaker device of claim 1, wherein the first waveguide has a substantially straight shape defined by one or more straight walls of the first recessed sidewall.

4. The speaker device of claim 1, wherein the first waveguide has a substantially curved shape defined by one or more curved segments of the first recessed sidewall.

5. The speaker device of claim 4, wherein the first waveguide is substantially cone-shaped, substantially cup-shaped, or substantially horn-shaped.

6. The speaker device of claim 4, wherein the smoothly curved region ends substantially tangential to the first top surface and forms a tangency angle with the first top surface.

7. The speaker device of claim 1, wherein the first top surface is substantially horizontal, substantially slanted, or substantially curved.

8. The speaker device of claim 1, wherein the smoothly curved region is further formed along a portion of a perimeter of the exit, the portion of the perimeter of the exit is on a side of a listener, and the shape of the first opening is substantially circular, substantially elliptical, or substantially quadrilateral.

9. The speaker device of claim 1, wherein an edge of the first upward-facing driver is spaced apart from a portion of the first recessed sidewall that adjoins the first recessed mounting surface.

10. The speaker device of claim 1, wherein an edge of the first upward-facing driver is substantially adjacent to a portion of the first recessed sidewall that adjoins the first recessed mounting surface.

11. The speaker device of claim 1, wherein:

the first housing further includes:

a second opening included in the first top surface;

a second recessed mounting surface spaced below the second opening; and a second recessed sidewall extending upwardly from the second recessed mounting surface to the second opening to form a second waveguide;

the speaker device further comprises a second upward-facing driver mounted into the second recessed mounting surface; and the second waveguide shapes propagation of acoustic energy generated by the second upward-facing driver to project the acoustic energy out of the speaker device in an upwardly inclined direction.

12. The speaker device of claim 11, wherein the acoustic energy generated by the second upward-facing driver is projected out of the speaker device in the upwardly inclined direction at an angle that is substantially seventy degrees relative to a horizontal plane to reflect the acoustic energy off a ceiling.

13. The speaker device of claim 11, wherein respective shapes of the first and second waveguides are at least partially distinct.

14. The speaker device of claim 11, wherein the first and second waveguides have respective exits defined by shapes of the first and second openings, and the shapes of the first and second openings are at least partially distinct.

15. The speaker device of claim 11, further comprising one or more forward-facing drivers oriented substantially perpendicular to the first top surface.

16. The speaker device of claim 15, wherein the speaker device is a soundbar.

17. The speaker device of claim 1, further comprising:

a second upward-facing driver mounted into the first recessed mounting surface;

wherein the first waveguide shapes propagation of acoustic energy generated by the second upward-facing driver to project the acoustic energy out of the speaker device in an upwardly inclined direction.

18. The speaker device of claim 17, wherein respective shapes of the first and second upward-facing drivers are at least partially distinct.

19. A method for producing a waveguide for a speaker device, comprising:

determining at least one waveguide property suitable for enhancing an amount of acoustic energy projected by an upward-facing driver of the speaker device in an upwardly inclined direction; and fabricating a housing of the speaker device based on the at least one waveguide property;

wherein the housing includes the waveguide defined by an opening included in a top surface of the housing, a recessed mounting surface of the housing spaced below the opening, a recessed sidewall extending upwardly and inclinedly from a diaphragm of the upward-facing driver to the opening, and a smoothly curved region spaced below the top surface, spaced above the recessed mounting surface, and formed between the recessed sidewall and the opening;

wherein the smoothly curved region transitions to an exit defined by a shape of the opening;

wherein the upward-facing driver is mounted into the recessed mounting surface; and wherein the waveguide shapes propagation of the acoustic energy to project the acoustic energy out of the speaker device in the upwardly inclined direction.

20. A method for enhancing an amount of acoustic energy projected by an upward-facing driver of a speaker device in an upwardly inclined direction, comprising:

generating, utilizing the upward-facing driver, the acoustic energy; and shaping propagation of the acoustic energy utilizing a waveguide of the speaker device to project the acoustic energy out of the speaker device in the upwardly inclined direction;

wherein the waveguide is defined by an opening included in a top surface of a housing of the speaker device, a recessed mounting surface of the housing spaced below the opening, a recessed sidewall extending upwardly and inclinedly from a diaphragm of the upward-facing driver to the opening, and a smoothly curved region spaced below the top surface, spaced above the recessed mounting surface, and formed between the recessed sidewall and the opening;

wherein the smoothly curved region transitions to an exit defined by a shape of the opening; and wherein the upward-facing driver is mounted into the recessed mounting surface.

* * * * *